US011864607B2

(12) United States Patent
Reynolds

(10) Patent No.: US 11,864,607 B2
(45) Date of Patent: Jan. 9, 2024

(54) STOWABLE GARMENT SYSTEM WITH QUICK RELEASE MECHANISM

(71) Applicant: NIKE, Inc., Beaverton, OR (US)

(72) Inventor: Jarrett L. Reynolds, Beaverton, OR (US)

(73) Assignee: NIKE, Inc., Beaverton, OR (US)

( * ) Notice: Subject to any disclaimer, the term of this patent is extended or adjusted under 35 U.S.C. 154(b) by 12 days.

(21) Appl. No.: 17/711,532

(22) Filed: Apr. 1, 2022

(65) Prior Publication Data

US 2022/0218046 A1 Jul. 14, 2022

Related U.S. Application Data

(63) Continuation of application No. 16/597,101, filed on Oct. 9, 2019, now Pat. No. 11,337,468, which is a
(Continued)

(51) Int. Cl.
*A45F 3/00* (2006.01)
*A41D 3/00* (2006.01)
(Continued)

(52) U.S. Cl.
CPC ..... *A41D 3/005* (2013.01); *A41D 3/04* (2013.01); *A41D 27/202* (2013.01);
(Continued)

(58) Field of Classification Search
CPC ..... A41D 3/005; A41D 27/202; A41D 3/04; A41D 2600/10; A41D 2200/10;
(Continued)

(56) References Cited

U.S. PATENT DOCUMENTS 258,844 A 5/1882 Young
485,509 A 11/1892 Speed
(Continued)

FOREIGN PATENT DOCUMENTS

DE 202006003077 U1 8/2006
GB 2177284 A 1/1987
(Continued)

OTHER PUBLICATIONS

"Foldable Waist Fanny Pack Poncho, Premium Industries", premiumindustries.com, Product ID: 6785905, http://www.premiumindustries.com/cre00024/foldable-waist-fanny-pack-poncho.html, 2014, 1 page.
(Continued)

*Primary Examiner* — Katharine G Kane
(74) *Attorney, Agent, or Firm* — SHOOK, HARDY & BACON L.L.P.

(57) ABSTRACT

Aspects herein are directed to a stowable garment system that allows for quick deployment and donning of an upper-body garment that is stowed within a pouch located on the front of a belt structure configured to encircle the waist of a wearer. The garment comprises at least a front section and a back section, where a portion of the front section is attached to the pouch. The garment further comprises a first tab extending from a bottom margin at a first side of the back section and a second tab extending from the bottom margin at a second opposite side of the back section. When stowed within the pouch, the tabs extend through one or more
(Continued)

openings in the pouch. The wearer may exert tension on the tabs to actuate a quick-release mechanism and enable the garment to be deployed and donned.

20 Claims, 18 Drawing Sheets

Related U.S. Application Data continuation of application No. 16/040,943, filed on Jul. 20, 2018, now Pat. No. 10,477,905.

(60) Provisional application No. 62/677,790, filed on May 30, 2018.

(51) Int. Cl.
*A41D 27/20* (2006.01)
*A41D 3/04* (2006.01)

(52) U.S. Cl.
CPC ..... *A41D 2200/10* (2013.01); *A41D 2200/20* (2013.01); *A41D 2300/32* (2013.01); *A41D 2400/422* (2013.01); *A41D 2600/10* (2013.01); *A45F 3/005* (2013.01)

(58) Field of Classification Search
CPC ..... A41D 2400/422; A41D 2300/32; A41D 2200/20; A41D 15/04; A41D 2400/442; A41D 2400/424; A41D 15/00; A41F 9/002; A45F 4/02; A45F 4/14
See application file for complete search history.

(56) References Cited

U.S. PATENT DOCUMENTS 1,385,695 A 7/1921 Maccormack et al.
1,474,826 A 11/1923 Hudec
1,477,788 A 12/1923 Toniutti
2,290,218 A 7/1942 Vosseller
2,314,433 A 3/1943 Rene
2,334,061 A 11/1943 Boris
2,729,410 A 1/1956 Moran
2,764,327 A 9/1956 Stevenson
3,024,824 A 3/1962 Bass
3,143,280 A 8/1964 Hiersteiner
3,185,362 A 5/1965 Wakefield
3,323,136 A 6/1967 Frederick
3,389,407 A 6/1968 Morrison
3,670,340 A 6/1972 Walker
3,835,471 A 9/1974 Lankford
3,998,304 A 12/1976 Edgerton et al.
4,029,243 A 6/1977 Zerobnick et al.
4,055,852 A 11/1977 Wallace
4,145,762 A 3/1979 Wallach
4,153,091 A 5/1979 Jahn
4,227,264 A 10/1980 Spector et al.
4,244,499 A 1/1981 Adams
4,347,629 A 9/1982 Itoi
4,370,755 A 2/1983 Crumby
4,404,687 A 9/1983 Hager
4,423,834 A 1/1984 Rush
4,476,587 A 10/1984 Itoi
D277,048 S 1/1985 Peyser
D277,049 S 1/1985 Peyser
4,502,154 A 3/1985 Itoi
4,523,703 A 6/1985 Mckenna
4,562,952 A 1/1986 Chinman
D289,228 S 4/1987 Chinman
4,792,040 A 12/1988 Wagstaff
4,881,684 A 11/1989 Chinman
4,932,574 A 6/1990 Doshi
4,949,887 A 8/1990 Holmes
5,002,401 A 3/1991 Blackman
5,003,634 A 4/1991 Brinkman
5,040,243 A 8/1991 Tatsuno
5,269,023 A 12/1993 Ross
5,289,960 A 3/1994 Kelly et al.
5,327,669 A 7/1994 Lannan et al.
5,346,308 A 9/1994 Buhot et al.
5,370,113 A 12/1994 Parsons
5,452,476 A 9/1995 Jenks
5,499,401 A 3/1996 Heinmiller
5,564,125 A 10/1996 Waldman et al.
5,570,824 A 11/1996 Lyon et al.
5,586,706 A 12/1996 Ritzenhein
5,615,769 A 4/1997 Stephenson
5,704,531 A 1/1998 Nam
5,725,139 A 3/1998 Smith
D395,751 S 7/1998 Dominique
5,787,504 A 8/1998 Wu
5,860,164 A 1/1999 Johnson
D414,013 S 9/1999 Group
6,216,933 B1 4/2001 Healy
6,296,164 B1 10/2001 Russo
6,353,933 B1 3/2002 Love
6,360,370 B1 3/2002 Ferreras
6,370,692 B1 4/2002 Duyn et al.
6,385,775 B1 5/2002 Komjati
6,421,834 B2 7/2002 Kester
6,457,635 B1 10/2002 Scicluna
6,658,665 B2 12/2003 Dodge
6,715,160 B2 4/2004 Crye et al.
6,739,754 B2 5/2004 Moor et al.
6,966,439 B2 11/2005 Weleczki
7,201,299 B2 4/2007 Forsman
8,104,654 B2 1/2012 Overton
8,240,610 B1 8/2012 Cooper
D677,859 S 3/2013 Andes
8,464,374 B1 6/2013 Thayer
8,511,466 B1 8/2013 Harris
D691,795 S 10/2013 Do
D692,655 S 11/2013 Perrea et al.
9,427,031 B2 8/2016 Apostoloff
9,656,758 B2 5/2017 Reinpold
9,775,387 B2 10/2017 Parr
9,874,423 B1 1/2018 Hughes
9,901,161 B2 2/2018 Blanton
D836,332 S 12/2018 Gash
2003/0178332 A1 9/2003 Lindamood
2004/0055074 A1 3/2004 Lin
2005/0198723 A1 9/2005 Green
2005/0199715 A1 9/2005 Reid
2006/0000004 A1 1/2006 Elen
2006/0059597 A1 3/2006 Larocco
2007/0194073 A1 8/2007 Szabo
2008/0120769 A1 5/2008 Gollin
2008/0271222 A1 11/2008 Nienow
2009/0241235 A1 10/2009 Weinreb
2010/0031413 A1 2/2010 Jensen
2010/0320241 A1 12/2010 Thompson
2012/0055963 A1 3/2012 Phair
2012/0152772 A1 6/2012 Garner
2012/0312852 A1 12/2012 Smalley
2013/0019378 A1 1/2013 White
2013/0212772 A1 8/2013 Apostoloff
2014/0137308 A1 5/2014 Koo
2014/0345029 A1 11/2014 Saladino
2014/0373246 A1 12/2014 Chapuis
2015/0013046 A1 1/2015 Coleman et al.
2015/0189924 A1 7/2015 Desbrow
2015/0203281 A1 7/2015 Russo
2015/0250240 A1 9/2015 Hunkele
2016/0143424 A1 5/2016 Stephens et al.
2016/0157535 A1 6/2016 Tirro et al.
2016/0174633 A1 6/2016 Macrae
2016/0270460 A1 9/2016 Rabinowitz
2018/0092410 A1 4/2018 Rundle
2018/0213952 A1 8/2018 Penn et al.
2018/0235352 A1 8/2018 Jones et al.
2019/0075916 A1 3/2019 Becker

(56) References Cited

U.S. PATENT DOCUMENTS

| | | | |
|---|---|---|---|
| 2019/0364985 | A1 | 12/2019 | Sachs et al. |
| 2020/0037678 | A1 | 2/2020 | Sachs et al. |

FOREIGN PATENT DOCUMENTS

| | | | |
|---|---|---|---|
| GB | 2388766 | A | 11/2003 |
| WO | 2012/062950 | A1 | 5/2012 |

OTHER PUBLICATIONS

"Outdoor Products Multi-Purpose Poncho", REI—Recreational Equipment, rei.com, Item# 743067, http://www.rei.com/producl/743067/outdoor-products-multi-purpose-poncho, 2014, 1 page.

"Oxford Roll Up Rain Cape", John Boultbee, Brooks England, http://www.brooksengland.com/catalogue-and-shop/clothing/john+boultbee+clothing/OXFORD+Roll+Up+Rain+Cape/#sidecontents, 2010, 1 page.

"Why Rain Capes Are Awesome", Clever Cycles, clevercycles.com, Available online at: <http://clevercycles.com/blog/2013/09/26/why-rain-capes-are-awesome/>, Sep. 26, 2018, 2 pages.

Office Action received for European Patent Application No. 19722248.2, dated Jan. 17, 2023, 4 pages.

STOWABLE GARMENT SYSTEM WITH QUICK RELEASE MECHANISM

CROSS-REFERENCE TO RELATED APPLICATIONS

This application, entitled "Stowable Garment System with Quick Release Mechanism," is a continuation application of co-pending U.S. application Ser. No. 16/597,101 (entitled "Stowable Garment System with Quick Release Mechanism;" filed Oct. 9, 2019), which is a continuation application of U.S. application Ser. No. 16/040,943 (entitled "Stowable Garment System with Quick Release Mechanism;" filed Jul. 20, 2018; and issued as U.S. Pat. No. 10,477,905 on Nov. 19, 2019), which claims priority to U.S. Provisional App. No. 62/677,790 (entitled "Stowable Garment System with Quick Release Mechanism;" filed May 30, 2018). The entireties of the aforementioned applications are incorporated by reference herein.

TECHNICAL FIELD

Aspects herein relate to a stowable garment system with a quick-release mechanism that enables rapid deployment and donning of a garment that is in a stowed state.

BACKGROUND

Traditional stowable garment systems generally require the wearer to carry out two or more steps to convert the garment from a stowed state to a worn state. These steps may be cumbersome and time consuming thus preventing rapid deployment and donning of the garment.

DESCRIPTION OF THE DRAWINGS

Examples of aspects herein are described in detail below with reference to the attached drawings figures, wherein.

DETAILED DESCRIPTION

Figure 1:
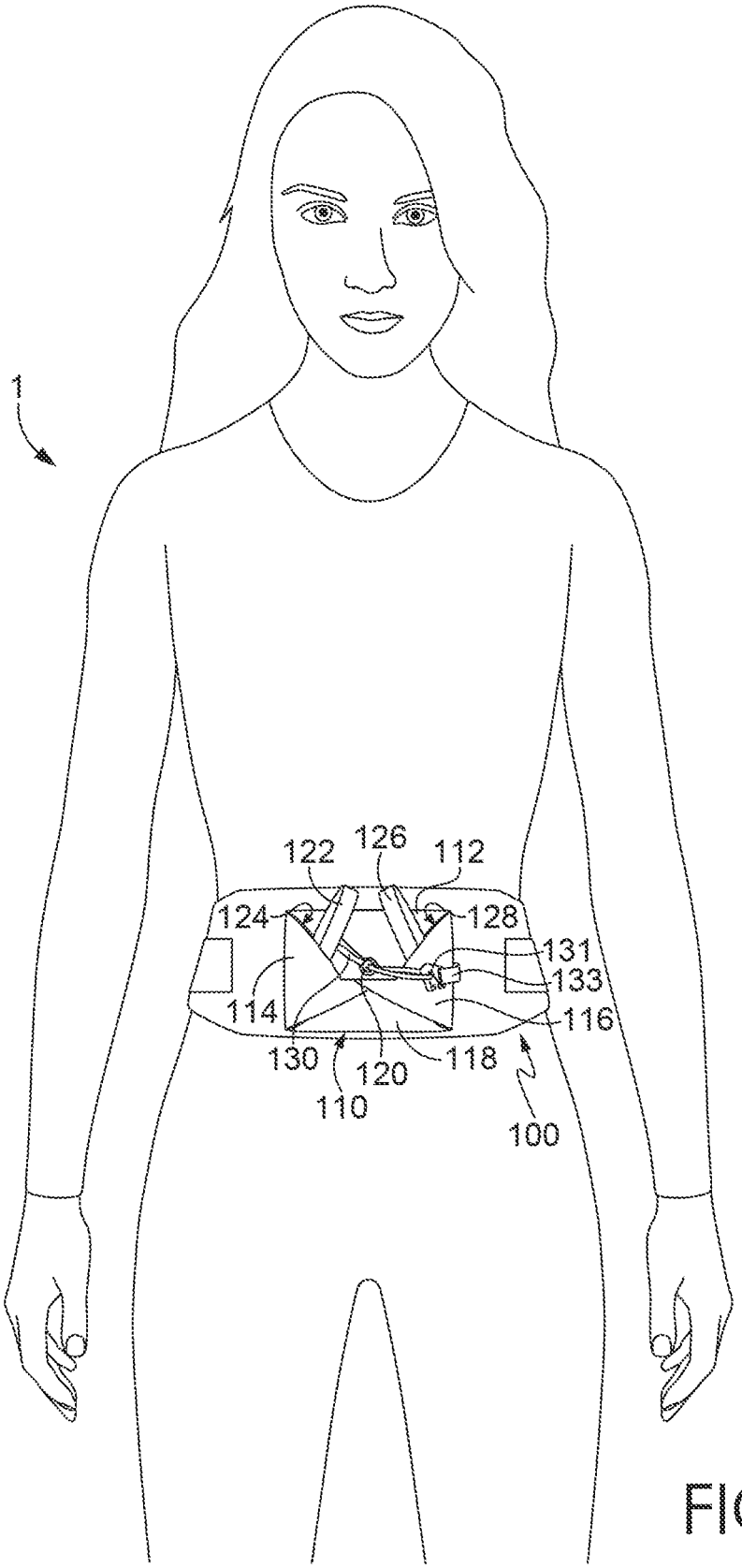
FIGS. 1-4 illustrate an example method of donning an upper-body garment stowed within an example pouch positioned on a front aspect of an example belt structure in accordance with aspects herein.

The subject matter of the present invention is described with specificity herein to meet statutory requirements. However, the description itself is not intended to limit the scope of this disclosure. Rather, the inventors have contemplated that the claimed or disclosed subject matter might also be embodied in other ways, to include different steps or combinations of steps similar to the ones described in this document, in conjunction with other present or future technologies. Moreover, although the terms "step" and/or "block" might be used herein to connote different elements of methods employed, the terms should not be interpreted as implying any particular order among or between various steps herein disclosed unless and except when the order of individual steps is explicitly stated.

At a high level, aspects herein are directed to a stowable garment system that allows for quick deployment and donning of an upper-body garment that is stowed within a pouch located on the front of a belt structure configured to encircle the waist of a wearer. In aspects, the deployment and donning of the upper-body garment may be executed in a single continuous movement by a wearer. In aspects, the upper-body garment comprises at least a front section and a back section, where a portion of the front section is attached to the pouch. The upper-body garment further comprises a first tab extending from a bottom margin at a first side of the back section and a second tab extending from the bottom margin at a second opposite side of the back section.

Continuing, when the pouch is in a closed state, it may comprise a first opening and a second opening. When the upper-body garment is stowed within the pouch, the first tab extends through the first opening and the second tab extends through the second opening of the pouch. The stowable garment system further comprises a quick-release mechanism that enables the pouch to quickly open when tension is exerted on the tabs extending through the openings in the pouch. As explained further below, the quick-release mechanism may comprise a cord and hook system, a cord and clasp system, a slider system on the pouch, a snap system on the pouch, and the like.

In one aspect, to deploy the upper-body garment from the pouch, a wearer can exert a generally forward or anterior tension on the tabs extending through the pouch openings. The tension exerted on the tabs causes the quick-release mechanism to actuate, and the pouch to quickly open. The wearer can continue to exert tension on the tabs to pull the upper-body garment over the head and torso of the wearer thereby donning the garment. Once donned, the bottom margin of the front portion of the upper-body garment covers the pouch opening thereby preventing, for instance, precipitation from entering the open pouch. The ability to quickly deploy a garment from a stowed state to a worn state in one continuous motion may be useful in weather conditions that rapidly change such as a rain shower or snow shower or in cold or cool weather conditions.

Accordingly, aspects herein are directed to a stowable garment system comprising a belt structure having a pouch positioned on a front aspect of the belt structure, and an upper-body garment comprising a front section, a back section, and a bottom margin. A portion of the front section is attached to the pouch, and the back section comprises a first tab extending from the bottom margin at a first side of the back section and a second tab extending from the bottom margin at a second opposite side of the back section.

In another aspect, a stowable garment system is provided. The stowable garment system comprises a belt structure having a first pouch positioned on a front aspect of the belt structure. The first pouch comprises a second component of a quick-release mechanism effective to open and close the first pouch. The first pouch further comprises at least a first opening and a second opening. The stowable garment system further comprises an upper-body garment configured to be stowed within the first pouch. The upper-body garment comprises at least a front section, a back section, and a bottom margin, where a portion of the front section is attached to first pouch. The back section of the upper-body garment comprises a first tab extending from the bottom margin at a first side of the back section and a second tab extending from the bottom margin at a second side of the back section. The first tab comprises a first component of the quick-release mechanism. When the upper-body garment is stowed within the pouch structure, the first tab extends through the first opening of the pouch and the first component of the first tab is configured to releasably mate with the second component located on the pouch. Further, the second tab of the upper-body garment extends through the second opening of the pouch.

In yet another aspect, a method for transitioning an upper-body garment from a stowed state to a worn state is provided. With respect to this aspect, the upper-body garment comprises a front section, a back section, a bottom margin, a first tab extending from the bottom margin at a first side of the back section and a second tab extending from the bottom margin at a second side of the back section. The method comprises stowing the upper-body garment in a pouch located on a front aspect of a belt structure configured to be worn around a waist of a wearer. The pouch comprises a quick-release mechanism effective to open and close the pouch. A portion of the front section of the upper-body garment is attached to the pouch, the first tab of the upper-body garment extends through a first opening in the pouch, and the second tab of the upper-body garment extends through a second opening in the pouch. The method further comprises exerting a tension force on the first tab and the second tab of the upper-body garment to cause the quick-release mechanism to actuate, the pouch to open, and the upper-body garment to be deployed from the pouch. The method additionally comprises positioning the upper-body garment over a head and torso portion of the wearer by continuing to exert the tension force on the first tab and the second tab.

Positional terms as used herein to describe an upper-body garment, the belt structure, and/or the pouch such as "front," "back," "upper," "lower," "bottom," "inner-facing surface," "outer-facing surface," and the like are with respect to an appropriately sized upper-body garment, pouch, and/or belt structure being worn as intended and as shown and described herein by a wearer standing in an upright position. The term "about" when used in relation to measurements means within ±10% of a designated value. Terms such as "attached," "secured," "affixed," and the like may mean elements that are releasably attached to one another using, for example, snap systems, slider systems, hook-and-loop closure systems, releasable adhesives, buttons, hooks, and the like. These terms may further mean elements that are fixedly attached to one another using, for example, stitching, bonding, welding, and the like.

Continuing, the term "quick-release mechanism" as used herein is meant to encompass a variety of different mechanisms that enable the pouch to quickly open and the upper-body garment to be deployed from the pouch. Some example quick-release mechanisms may be located solely on the pouch and/or belt structure. Examples of these may include slider systems, snap systems including magnetic snap systems, hook-and-loop closure systems, and the like. Other example quick-release mechanisms may be located partially on the upper-body garment and partially on the pouch and/or belt structure. For instance, and as will be explained more fully below, the pouch may comprise a second component of a quick release mechanism and the upper-body garment may comprise a first component of the quick release mechanism where the first component is configured to releasably mate with the second component when the pouch is in a closed state and the upper-body garment is stowed within the pouch. In one aspect, the first component may comprise a first looped cord segment, and the second component may comprise a second looped cord segment. A loop portion of the first cord segment may be configured to extend through a loop portion of the second looped cord segment before being releasably secured to a hook extending from the pouch. In other aspects, the first component may comprise a female part of a snap, and the second component may comprise the male part of a snap. Other examples include a hook component and a loop component of a hook-and-loop fastener system, a quick-release buckle system, and the like.

Continuing still, the term "closed state" used when describing the pouch may describe a pouch that is at least about 80% closed but that still has one or more openings. In other words, the term "closed state" as used herein is not meant to imply that the pouch is 100% closed such that there are no openings remaining. In line with this, the terms "first opening" and "second opening" used when describing openings in the pouch may mean two separate openings separated from each other by portions of the pouch or it may mean two different locations within a single opening. For instance, when there is a single opening, the term "first opening" may refer to a left-hand side of the opening and the term "second opening" may refer to a right-hand side of the opening. Any and all aspects, and any variation thereof, are contemplated as being within aspects herein.

Turning now to FIGS. 1-4, an example method of quickly deploying and donning an upper-body garment that is part of a stowable garment system is provided in accordance with aspects herein. With respect to FIG. 1, a wearer 1 is shown wearing a belt structure 100 around a waist area of the wearer 1. The belt structure 100 comprises a pouch 110 positioned on a front aspect of the belt structure 100. As will be explained more fully below, in aspects, the pouch 110 comprises a first flap 112 positioned generally at the top of the pouch 110 and having a hole extending therethrough, a second flap 114 positioned generally on a first side of the pouch 110 and having a hole extending therethrough, a third flap 116 positioned generally on a second opposite of the pouch 110 and having a hole extending therethrough, and a fourth flap 118 positioned generally on the bottom side of the pouch 110. In aspects, the fourth flap 118 comprises a second looped cord segment 120 (i.e., a second component of a quick-release mechanism). When the pouch 110 is in a closed state, flaps 112, 114, 116, 118 at least partially overlap each other so that the holes in the first, second, and third flaps 112, 114, and 116, are aligned or are in registration with each other.

Continuing, in aspects, when the pouch 110 is in the closed state, the fourth flap 118 may be positioned so as to be closest to the belt structure 100 (or the wearer 1 or the stowed upper-body garment) with the first, second, and third flaps 112, 114, and 116 interchangeably positioned next. With this configuration, the second looped cord segment 120 extends through the holes in the first, second, and third flaps 112, 114, and 116 before exiting and being positioned on an outer-facing surface of the pouch 110.

As further shown in FIG. 1, a first tab 122 may extend through a first opening 124 in the pouch 110, and a second tab 126 may extend through a second opening 128 in the pouch 110. In aspects, the first opening 124 and the second opening 128 may be formed between, for instance, the first flap 112 and the second and third flaps 114 and 116 respectively as shown in FIG. 1. Alternatively, first and second openings may be formed between the fourth flap 118 and the second and third flaps 114 and 116 respectively. As will be explained further below, the first tab 122 and the second tab 126 may be attached to the upper-body garment stowed within the pouch 110. In aspects, the first tab 122 and the second tab 126 may be releasably secured to the pouch 110 when not in use. Example structures used to releasably secure the first tab 122 and the second tab 126 to the pouch 110 may comprise, for example, hook-and-loop fasteners, a snap system, and the like. Further, in aspects, the first tab 122 may comprise a first looped cord segment 130 (i.e., a first component of the quick-release mechanism) whose loop portion is threaded through the loop portion of the second looped cord segment 120 after it extends through the holes in the first flap 112, the second flap 114, and the third flap 116. The loop portion of the first looped cord segment 130 may be temporarily and releasably secured to the pouch 110 using, for instance, a hook 131 attached to the pouch 110 by a tab 133.

Figure 2:
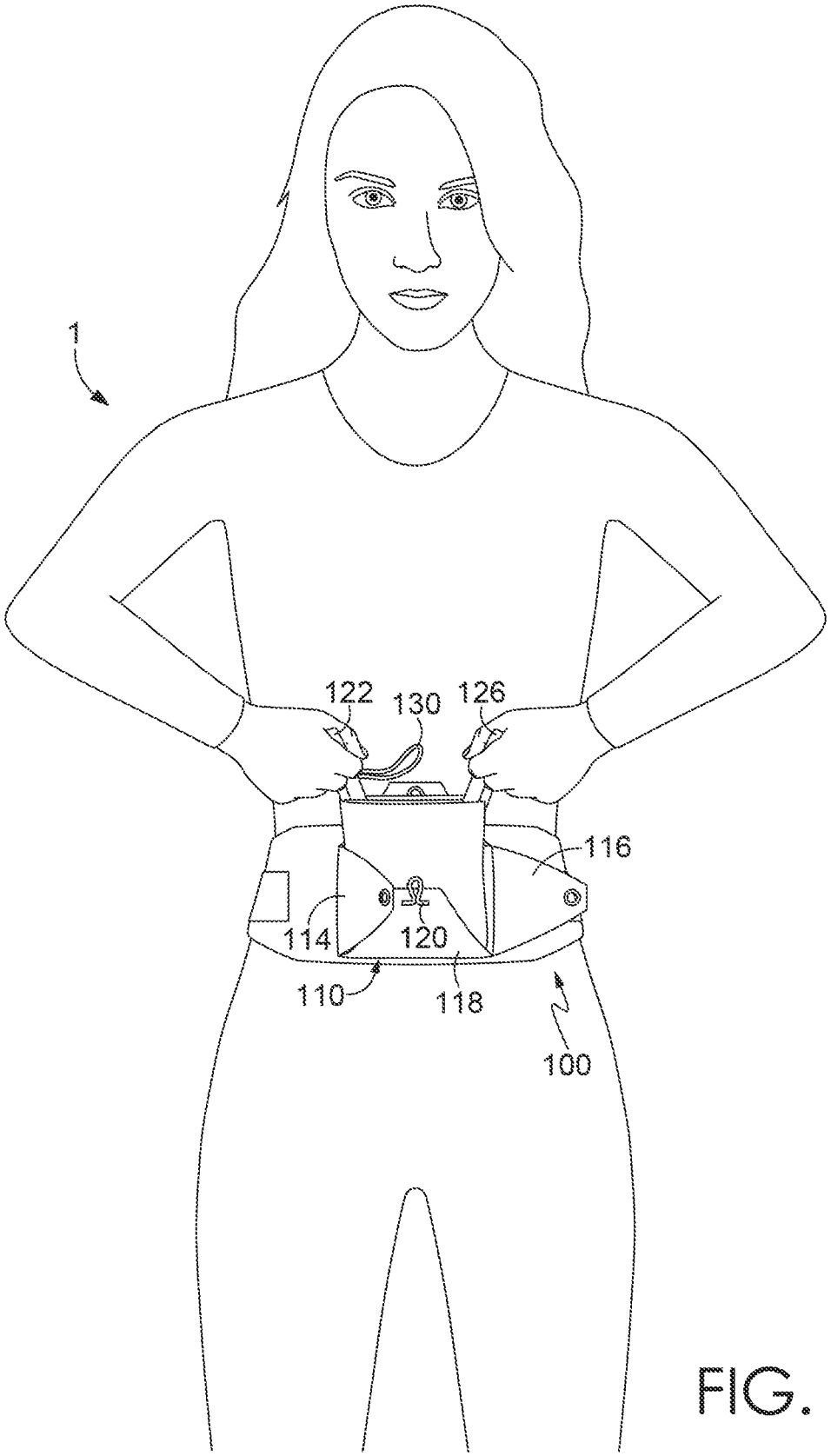

FIG. 2 depicts the wearer 1 beginning to exert a tension force on the first tab 122 and the second tab 126. In aspects, this may occur after the wearer 1 unsecures or releases the tabs 122 and 126 from the pouch 110 and after the wearer 1 releases the looped portion of the first looped cord segment 130 from the hook 131. More specifically, the wearer 1 exerts tension on the first tab 122 using the wearer's right hand and exerts tension on the second tab 126 using the wearer's left hand. Exerting tension on the first and second tabs 122 and 126 causes the first looped cord segment 130 to be pulled free from the second looped cord segment 120. Once the second looped cord segment 120 is disengaged from the first looped cord segment 130, continued tension on the first tab 122 and the second tab 126 causes the flaps 112, 114, 116, and 118 to extend anteriorly or outward (i.e., away from the belt structure 100 and away from the stowed upper-body garment). This is because the first tab 122 and the second tab 126 are part of the stowed upper-body garment and, as such, tension on the first and second tabs 122 and 126 causes the stowed upper-body garment to exert an anterior or outward force on the flaps 112, 114, 116, and 118 thereby causing the flaps to open. Upon the flaps 112, 114 and 116 opening, the second looped cord segment 120 is drawn back through the holes in the first flap 112, the second flap 114, and the third flap 116.

Figure 3:
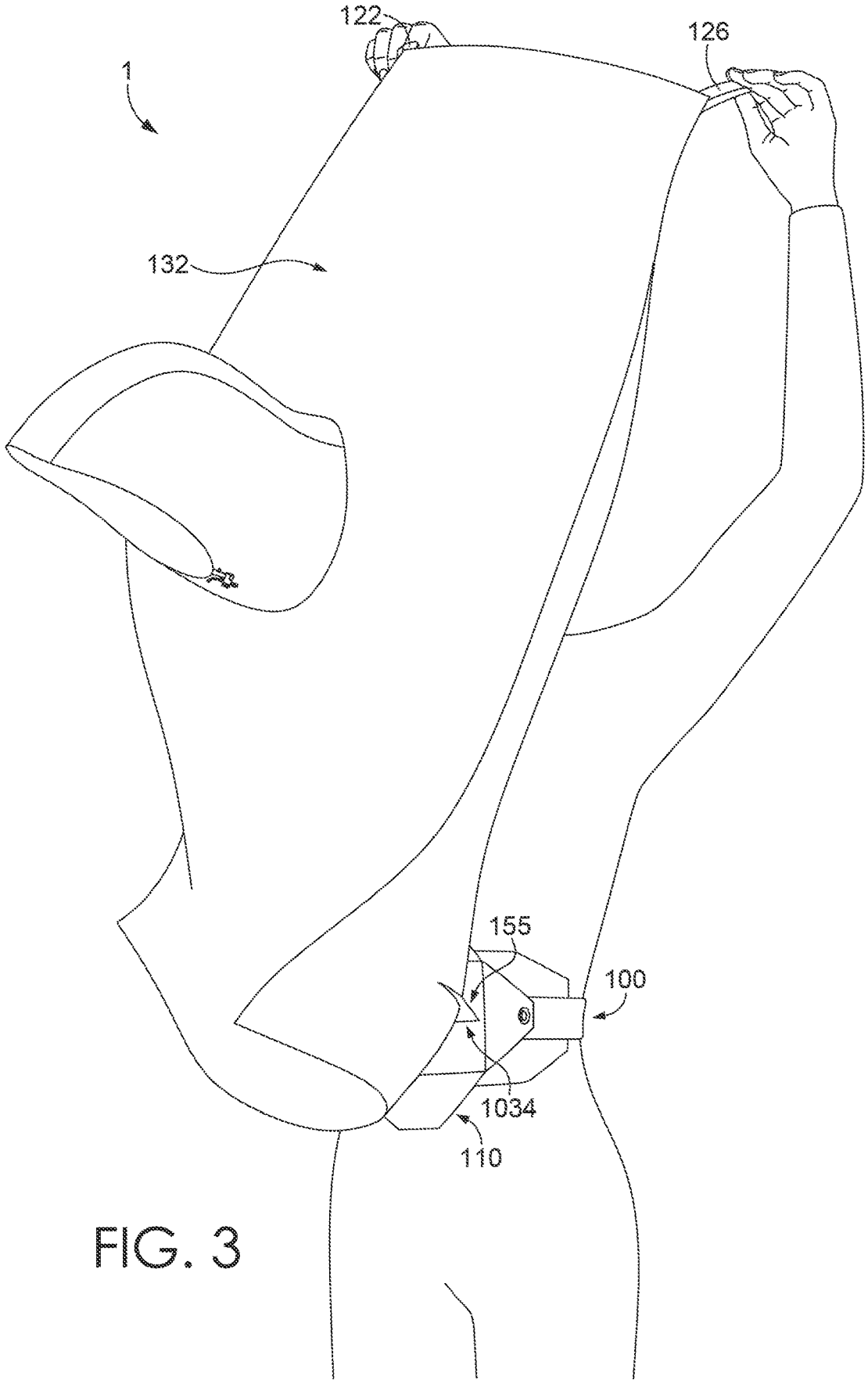

FIG. 3 depicts the wearer 1 continuing to exert tension on the first tab 122 and the second tab 126 to deploy the upper-body garment (indicated by reference numeral 132) from the pouch 110 and to pull the upper-body garment 132 over the wearer's head and upper torso. As seen, the first tab 122 extends from a bottom margin of the upper-body garment 132 at a first side of the back section of the upper-body garment 132, and the second tab 126 extends from the bottom margin of the upper-body garment 132 at a second opposite side of the back section of the upper-body garment 132. By positioning the tabs 122 and 126 in these areas, the wearer 1 can easily draw the upper-body garment 132 over the wearer's head by moving his or her arms in an upward and backward direction. In aspects, the movement to deploy the upper-body garment 132 from the pouch 110 and to pull the upper-body garment 132 over the wearer's head may be accomplished in a single action as opposed to multiple separate actions as with some traditional stowable garment systems.

FIG. 3 further depicts an attachment area between the upper-body garment 132 and the pouch 110. More specifically, an attachment flap 155 is positioned on an inner-facing surface of the front section of the upper-body garment 132. The free edge of the attachment flap 155 may be releasably or securedly affixed to an attachment area 1034 on an inner aspect of the pouch 110. This maintains an attachment point between the upper-body garment 132 and the pouch 110 even when the upper-body garment 132 is donned. By attaching the upper-body garment 132 to the pouch 110, inadvertent misplacement of the upper-body garment 132 may be avoided.

Figure 4:
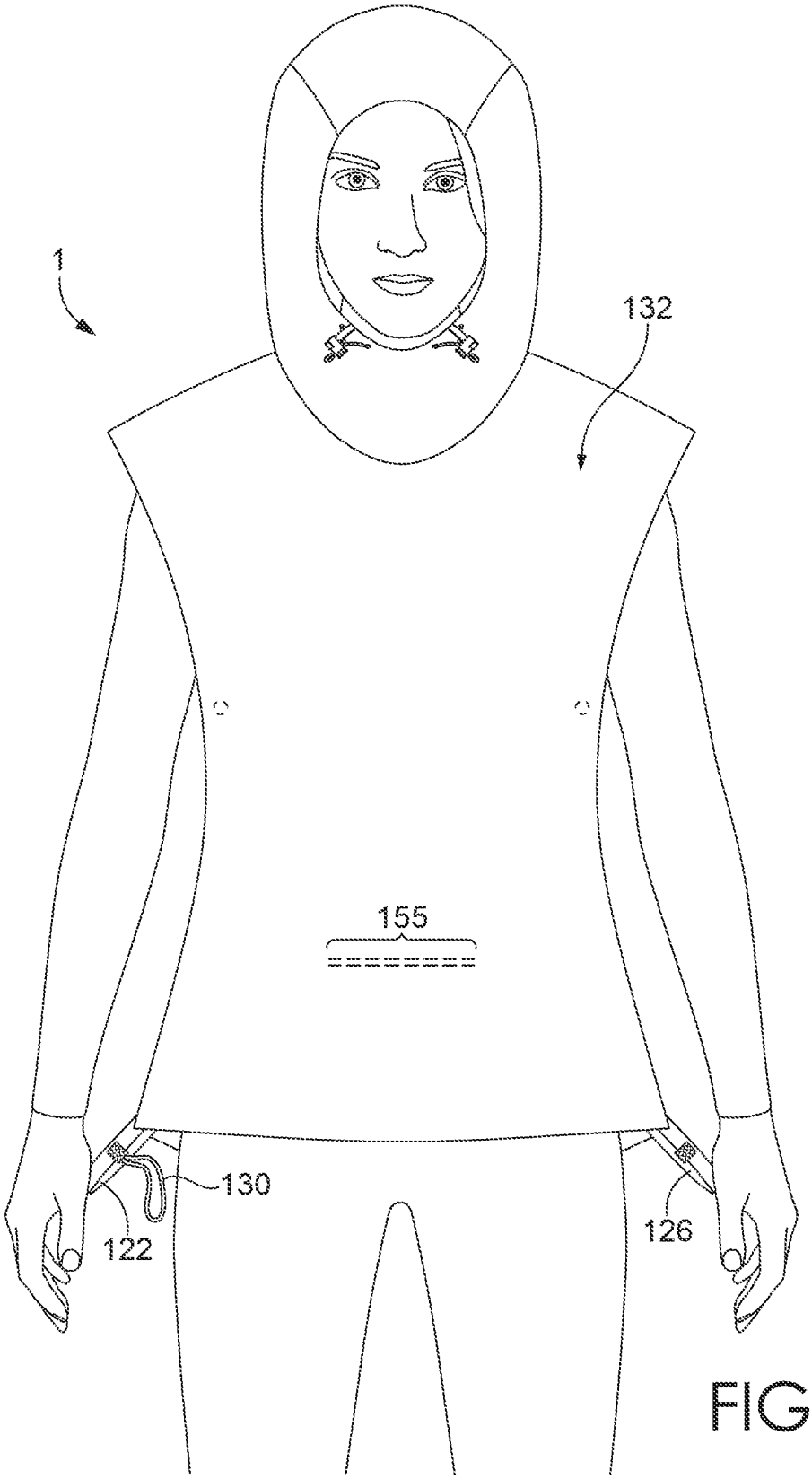

FIG. 4 depicts the wearer 1 with the upper-body garment 132 in an as-worn configuration. The upper-body garment 132, in aspects, may comprise a poncho construction with a hood. Because ponchos are generally open along the sides, this construction may allow for easier and quicker donning as opposed to more typical constructions with sleeves and/or sleeve openings that require the wearer to locate the sleeve opening and then insert his or her arms through the openings. The attachment flap 155 is shown as a series of dashed lines to indicate it is positioned on the inner-facing surface of the front section of the upper-body garment 132 and, therefore, is generally hidden from view. The attachment flap 155 is positioned so that the bottom margin of the front section of the upper-body garment 132 covers the pouch 110 and at least part of the belt structure 100 thereby, for instance, preventing precipitation from contacting the pouch 110 when the upper-body garment 132 is donned.

Figure 5:
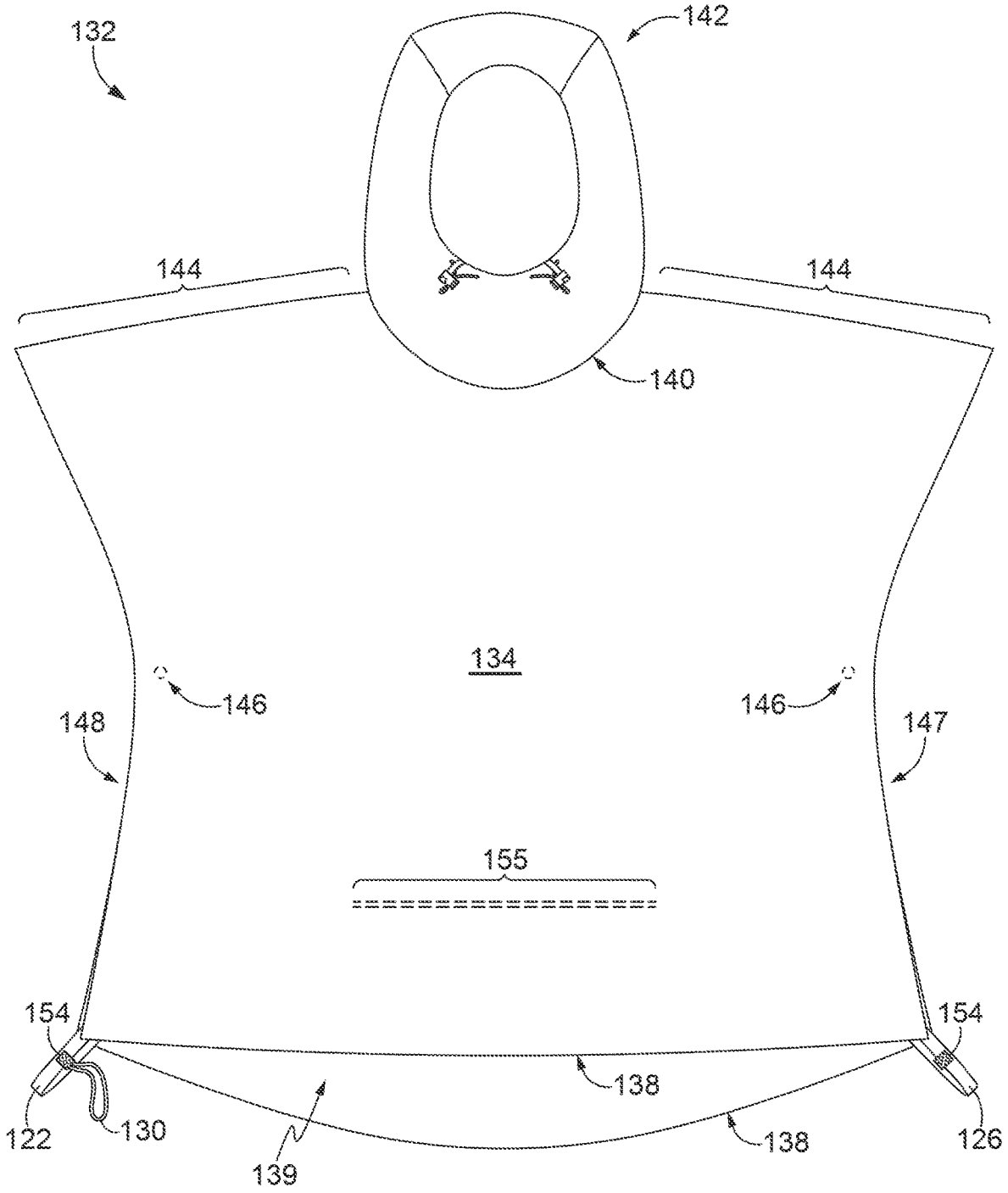
FIG. 5 illustrates a front view of the upper-body garment of FIGS. 1-4 in accordance with aspects herein.
Figure 6:
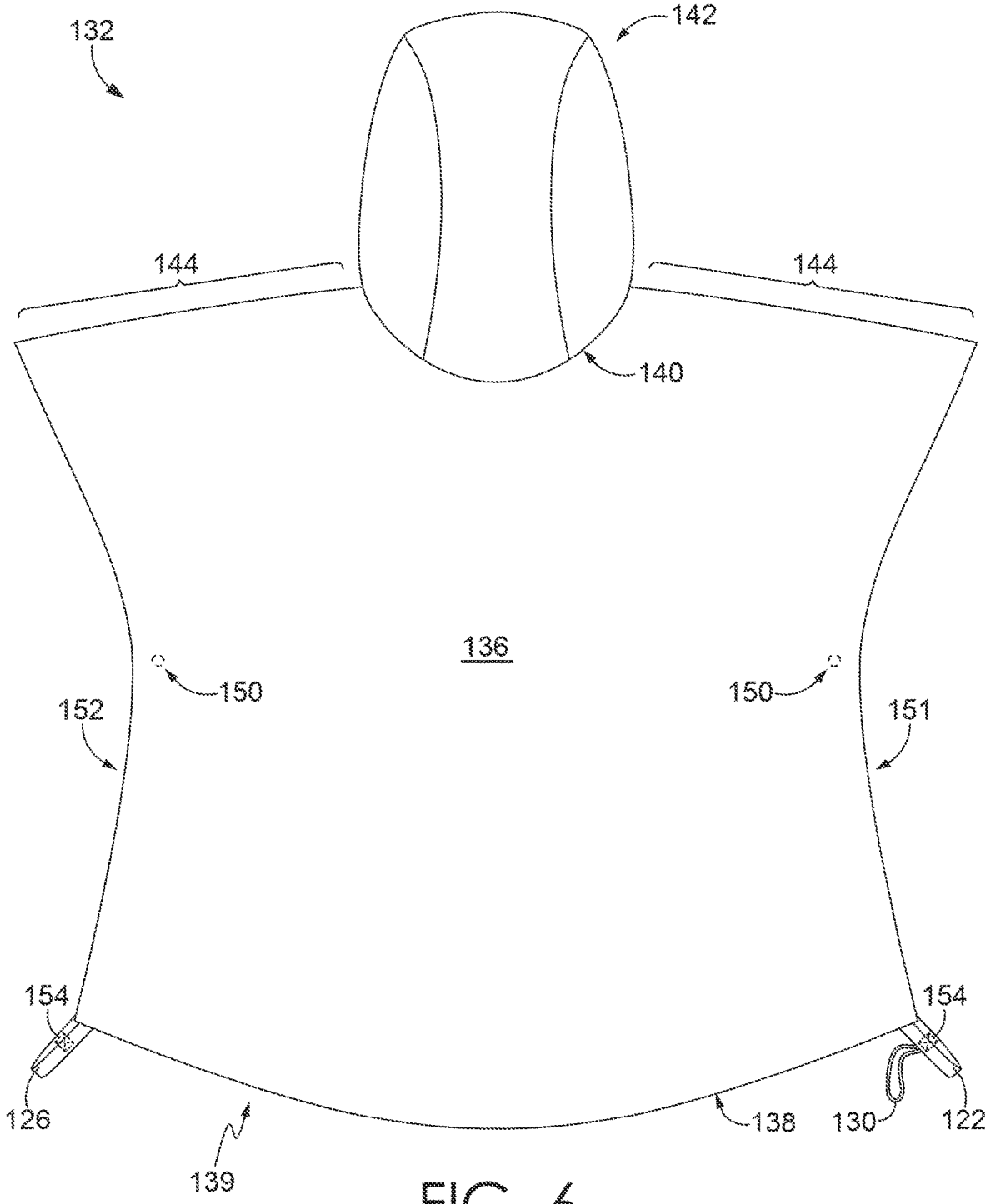
FIG. 6 illustrates a back view of the upper-body garment of FIG. 5 in accordance with aspects herein.

Turning now to more detailed views of the stowable garment system described herein, FIGS. 5 and 6 depict front and back views respectively of the upper-body garment 132 in accordance with aspects herein. In aspects, the upper-body garment 132 may be formed from a lightweight or ultra-lightweight tightly woven material constructed using, for example, polyester and/or nylon yarns. The material may comprise a weight from about 25 grams/square meter (GSM) to about 150 GSM. In one aspect, the material may comprise a weight less than about 100 GSM. In aspects, the material may be treated with a durable water repellent (DWR) on one or both of its surfaces to help make the upper-body garment 132 resistant to water penetration.

In aspects, the upper-body garment 132 may comprise a front section 134 (shown in FIG. 5), and a back section 136 (shown in FIG. 6), each having a bottom margin 138, where the bottom margins of each help to define a waist opening 139. As used herein, the term "bottom margin" may comprise a discontinuous margin comprised of a bottom margin associated with the front section 134 and a bottom margin associated with the back section 136. It is also contemplated herein, that the term bottom margin may comprise a continuous margin that extends continuously from the front section 134 to the back section 136. Any and all aspects, and any variation thereof, are contemplated as being within aspects herein. Continuing, the front section 134 and the back section 136 may define a neck opening 140. In aspects, an optional hood 142 may extend from the neck opening 140. Although not described in detail herein, the upper-body garment 132 may comprise additional features such as cord locks to tighten the hood opening, pockets, and the like.

The upper-body garment 132 may comprise a poncho construction in aspects and as shown in FIGS. 5 and 6. When configured as a poncho, the front section 134 may extend from the back section 136 at shoulder regions 144 of the upper-body garment 132 but may be unattached from the back section 136 along the sides of the upper-body garment 132. It is also contemplated herein that the upper-body garment 132 may assume a more traditional construction where the front and back sections 134/136 extend from each other along the shoulder regions 144 of the upper-body garment 132 and along the sides of the upper-body garment 132. In this aspect, the front and back sections 134/136 may further define sleeve openings from which sleeves may extend. Any and all aspects, and any variation thereof, are contemplated as being within aspects herein.

Continuing, and with respect to FIG. 5, when the upper-body garment 132 is configured as a poncho, the upper-body garment 132 may comprise first closure mechanisms 146 of a reversible closure system where the first closure mechanisms 146 are positioned on an inner-facing surface of the front section 134 (as indicated by the dashed lines) adjacent to (within about 0.5 cm to about 5 cm) side margins 147 and 148 of the front section 134. In aspects, the first closure mechanisms 146 may be further positioned generally equidistant (± about 0.5 cm to about 15 cm) between upper and lower ends of the side margins 147 and 148. With respect to FIG. 6, the upper-body garment 132 may comprise second closure mechanisms 150 of the reversible closure system, where the second closure mechanisms 150 are positioned on an inner-facing surface of the back section 136 (as indicated by the dashed lines) adjacent to (within about 0.5 cm to about 5 cm) side margins 151 and 152 of the back section 136. In aspects, the second closure mechanisms 150 may be further positioned generally equidistant (± about 0.5 cm to about 15 cm) between upper and lower ends of the side margins 151 and 152.

In aspects, the first closure mechanisms 146 and the second closure mechanisms 150 of the reversible closure system are complementary to each other. Examples include male and female parts of a snap system, hook and loop components of a hook-and-loop closure system, buttons and buttons holes, and the like. The first closure mechanisms 146 are configured to be releasably mated to the second closure mechanisms 150 when the upper-body garment 132 is donned thereby creating arm holes through which the wearer's arms may extend. The use of the first and second closure mechanisms 146 and 150 may help to further secure the upper-body garment 132 to the wearer when donned.

Turning back to FIG. 5, and as previously described, the front section 134 of the upper-body garment 132 may comprise the attachment flap 155 located on an inner-facing surface of the front section 134 (the use of dashed lines indicates that the attachment flap 155 may be hidden from view), where the attachment flap 155 is attached to the attachment area 1034 located on the inner aspect of the pouch 110. In aspects, the attachment flap 155 may be fixedly attached (e.g., by stitching, bonding, welding, and the like) to the attachment area 1034 located on the inner aspect of the pouch 110 or it may be releasably attached to the attachment area 1034. Any and all aspects, and any variation thereof, are contemplated as being within aspects herein. In aspects, the attachment flap 155 may be in a generally parallel alignment with the bottom margin 138 of the front section 134 (i.e. in a generally horizontal orientation) and may be spaced superior to the bottom margin 138 from about 5 cm to about 30 cm. Moreover, the attachment flap 155 may be from about 15 cm to about 40 cm in length.

Use of the attachment flap 155 to maintain an attachment between the upper-body garment 132 and the pouch 110 when the upper-body garment 132 is stowed or is worn, may help to prevent inadvertent misplacement of the upper-body garment 132 when not in use. Further, by positioning the attachment flap 155 a predefined distance superior to the bottom margin 138, the portion of the front section 134 positioned between the attachment flap 155 and the bottom margin 138 may help to cover the pouch 110 and/or part of the belt structure 100 when the upper-body garment 132 is donned thereby reducing the risk of precipitation from entering the pouch 110 and or contacting the belt structure 100.

Additionally with respect to FIG. 6, the upper-body garment 132 further comprises the first tab 122 and the second tab 126. In aspects, the first tab 122 extends from the bottom margin 138 of the back section 136 at a first side of the back section 136. The first tab 122 may be positioned from about 0.01 cm to about 10 cm from the side margin 151 of the back section 136. The second tab 126 extends from the bottom margin 138 of the back section 136 at a second opposite side of the back section 136. The second tab 126 may be positioned from about 0.01 to about 10 cm from the side margin 152 of the back section 136.

In aspects, each of the first tab 122 and the second tab 126 may comprise a fastener 154, where the fastener 154 is configured to releasably mate with a complementary second fastener located on the pouch 110 as detailed below. The fasteners 154 may be located on a front-facing side of the tabs 122 and 126 as seen in FIG. 5. In aspects, the fasteners 154 may comprise a hook component or a loop component of a hook-and-loop closure system although other fasteners are contemplated herein such as complementary snaps and the like. Stitching used to secure the fasteners 154 to the tabs 122 and 126 is shown in FIG. 6 although it is contemplated herein that the fasteners 154 may be fixedly affixed to the tabs 122 and 126 in other ways besides stitching.

With respect to the first tab 122, in aspects the first tab 122 may comprise a first component of a quick-release mechanism of the stowable garment system. In the aspect shown in FIGS. 5 and 6, the first component may comprise the first looped cord segment 130 fixedly attached to the first tab 122. The first looped cord segment 130, may interact with the second looped cord segment 120 (i.e., the second component of the quick-release mechanism) located on the pouch 110 to help maintain the pouch 110 in a closed state and to enable the pouch 110 to quickly open when tension is exerted on the first tab 122.

Figure 7:
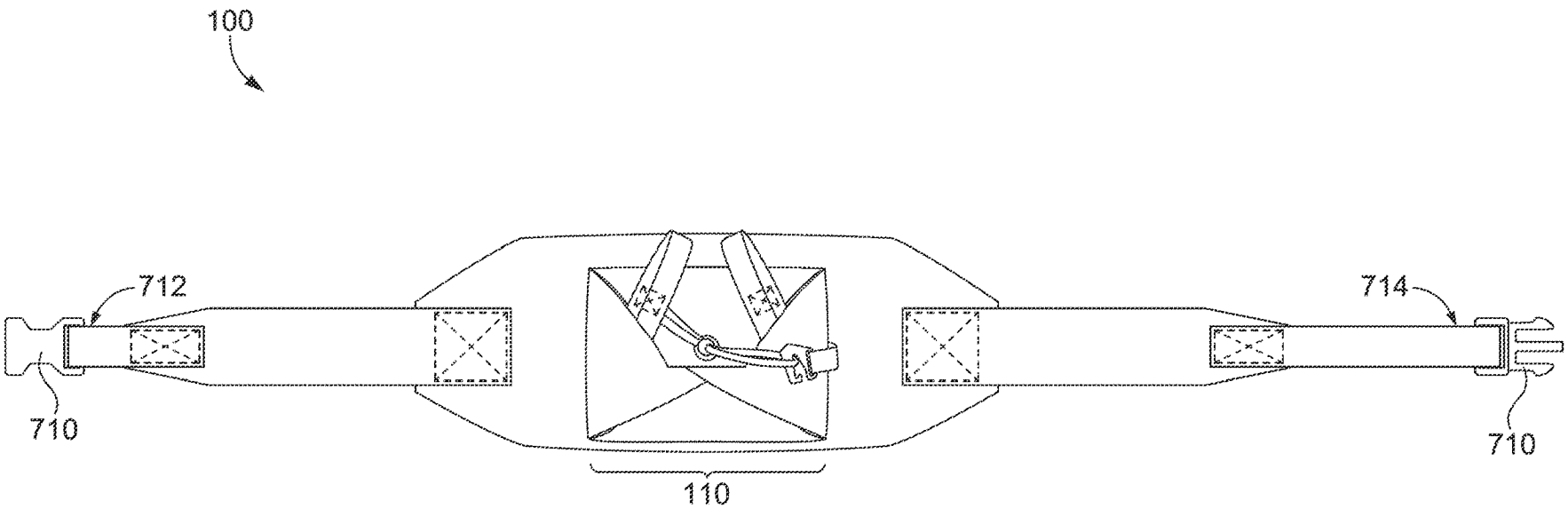
FIG. 7 illustrates the belt structure of FIGS. 1-4 in accordance with aspects herein.

Turning now to FIG. 7, a front view of the belt structure 100 is depicted in accordance with aspects herein. The belt structure 100 is configured to encircle the waist of a wearer and may comprise a buckle component 710 at each of a first end 712 and a second end 714 of the belt structure 100, where the buckle components 710 are configured to mate with each other and to optionally allow the wearer to adjust the girth of the belt structure 100. In aspects, the first end 712 and the second end 714 of the belt structure 100 are configured to be positioned at the back of the wearer when the belt structure 100 is worn. It is contemplated herein that the buckle components 710 may comprise any number of buckle types known in the art.

Figure 8:
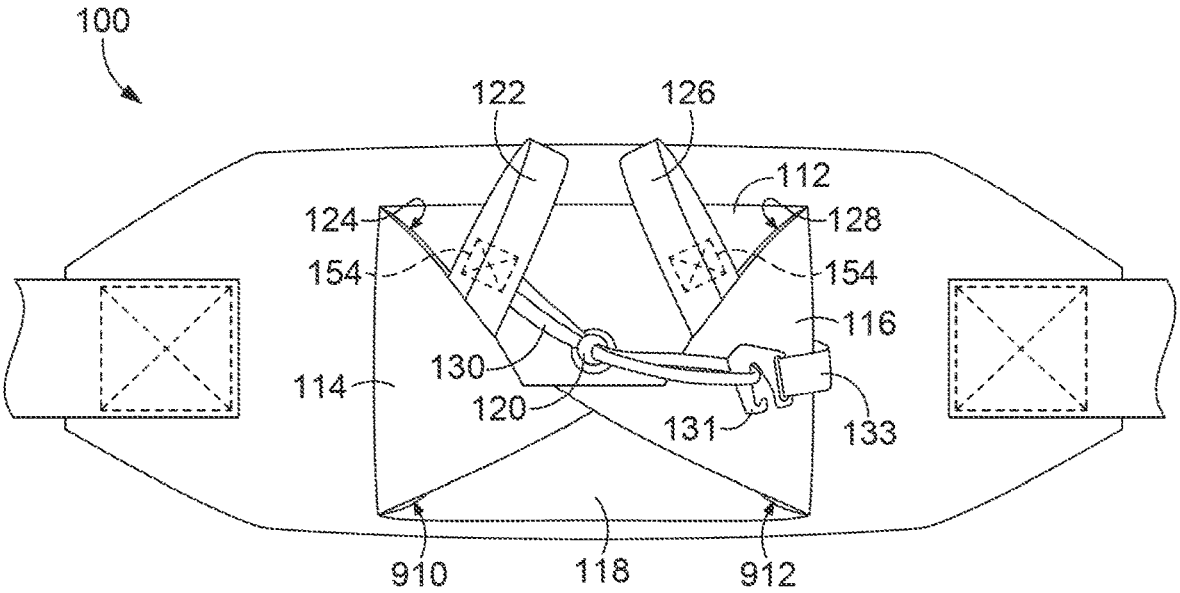
FIG. 8 illustrates a close-up view of the pouch of FIG. 7 with the pouch in a closed state in accordance with aspects herein.
Figure 9:
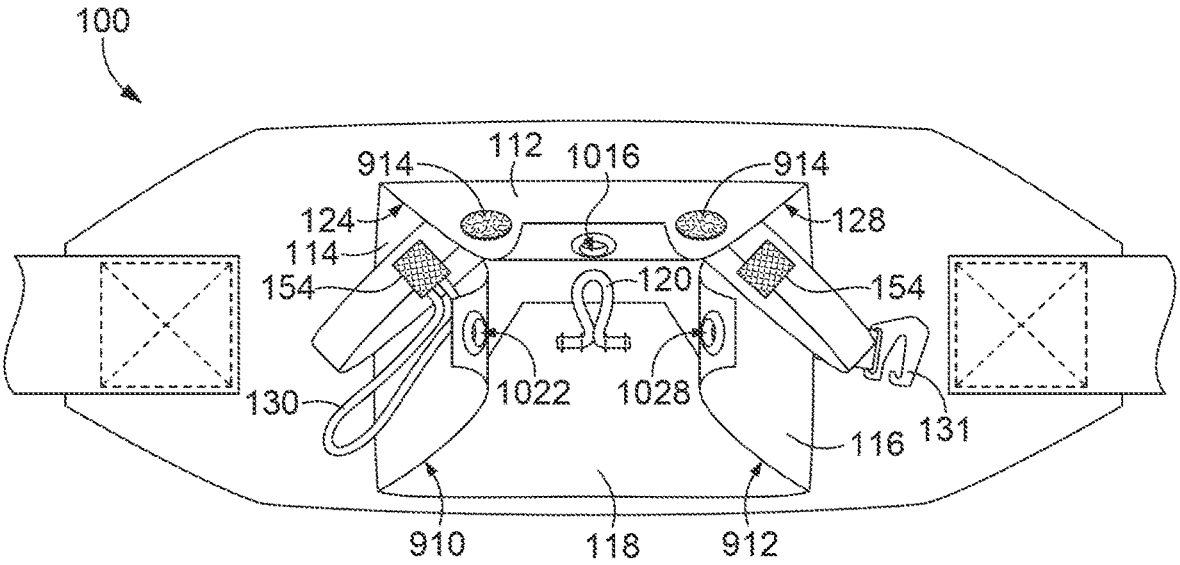
FIG. 9 illustrates the pouch of FIG. 8 with the pouch in a partially open state in accordance with aspects herein.
Figure 10:
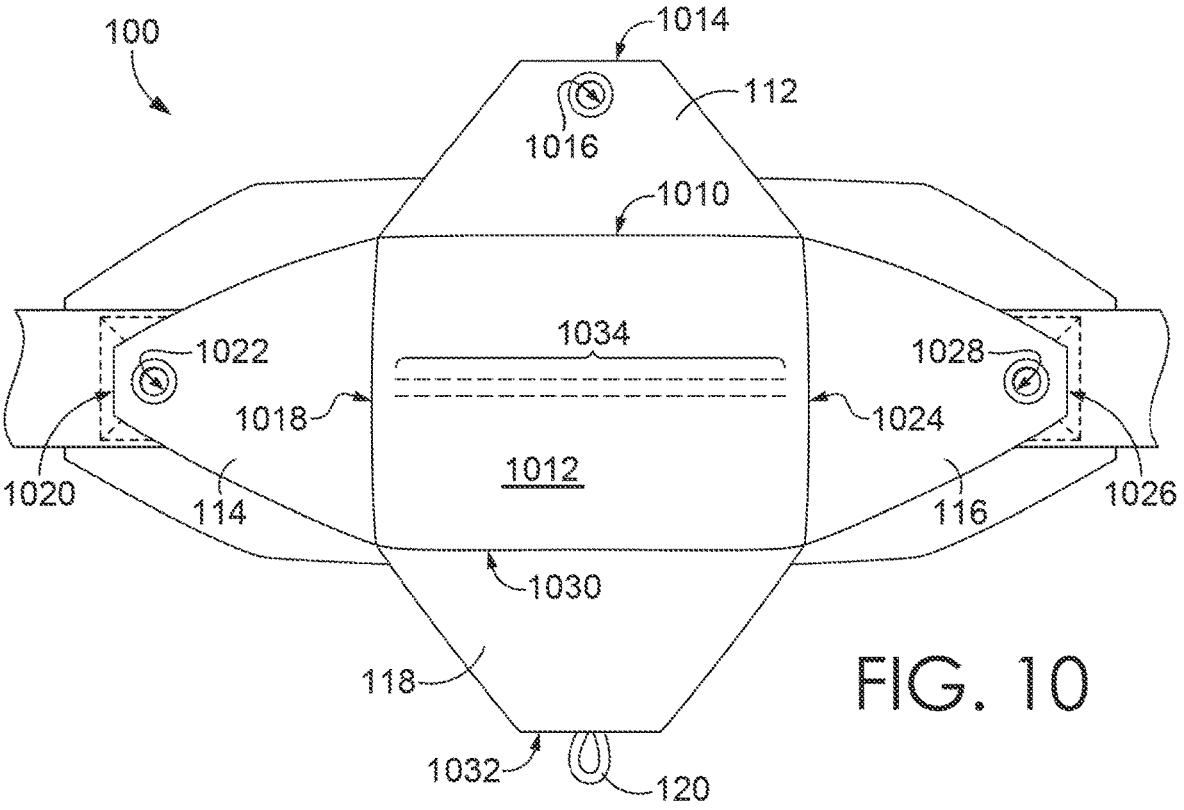
FIG. 10 illustrates the pouch of FIG. 8 with the pouch in an open state and with the upper-body garment removed in accordance with aspects herein.

The belt structure 100 further comprises the pouch 110 located at a front aspect of the belt structure 100 when the belt structure 100 is worn around the waist of a wearer. A close-up view of the pouch 110 is provided in FIGS. 8, 9, and 10. FIG. 8 depicts the pouch 110 in a closed state, FIG. 9 shows the pouch 110 as it begins to open, and FIG. 10 illustrates the pouch 110 completely open and with the upper-body garment 132 removed to better illustrate features of the pouch 110. With respect these figures, and more particularly with respect to FIG. 10, the pouch 110 comprises the first flap 112 having a free end 1014 and a flap edge 1010 extending from the top of a back panel 1012 of the pouch 110. The first flap 112 comprises a somewhat triangular shape with the free end 1014 comprising one of the vertices and the flap edge 1010 comprising the opposite base. The first flap 112 further comprises an aperture or hole 1016 extending through the first flap 112. The hole 1016 is located adjacent to (within about 0.01 cm to about 2 cm) of the free end 1014. In aspects, the hole 1016 may be reinforced with, for instance, a metal or plastic grommet or other type of surface treatment.

As best seen in FIG. 9, the first flap 112 further comprises fasteners 914 that are complementary to the fasteners 154 located on the first tab 122 and the second tab 126. The fasteners 914 are positioned on an outer-facing surface of the first flap 112 (with respect to the first flap 112 being in a closed state) and are positioned generally adjacent to the flap edge 1010 on opposing sides of the flap edge 1010. In aspects, the fasteners 914 may comprise complementary hook or loop material that is complementary to the hook or loop material of the fasteners 154. The fasteners 914 may also comprise complementary snaps (magnetic or standard) and the like.

Continuing with respect to FIG. 10, the pouch 110 further comprises the second flap 114 having a free end 1020 and a flap edge 1018 extending from a first side of the back panel 1012. The second flap 114 also comprises a somewhat triangular shape with the free end 1020 comprising one of the vertices and the flap edge 1018 comprising the opposite base. The second flap 114 further comprises an aperture or hole 1022 extending through the second flap 114 adjacent to the free end 1020. Like the hole 1016, the hole 1022 may be reinforced with a grommet or other type of surface treatment.

Additionally, the pouch 110 comprises the third flap 116 having a free end 1026 and a flap edge 1024 extending from a second opposite side of the back panel 1012. The third flap 116 comprises a somewhat triangular shape as well with the free end 1026 comprising one of the vertices and the flap edge 1024 comprising the opposite base. The third flap 116 also comprises an aperture or hole 1028 extending through the third flap 116 adjacent to the free end 1026, where the hole 1028 may be reinforced with a grommet or other type of surface treatment.

In a similar way, the pouch 110 comprises the fourth flap 118 having a free end 1032 and a flap edge 1030 extending from a bottom side of the back panel 1012. The fourth flap 118 additionally comprises a somewhat triangular shape with the free end 1032 comprising one of the vertices and the flap edge 1030 comprising the opposite base. The fourth flap 118 comprises the second looped cord segment 120 affixed to, for example, an outer-facing surface of the fourth flap 118 as best seen in FIG. 9. With respect to FIG. 10, the back panel 1012 of the pouch 110 comprises the attachment area 1034 which is where the attachment flap 155 of the front section 134 of the upper-body garment 132 attaches to the pouch 110.

In aspects, each of the flaps 112, 114, 116, and 118 may comprise separate pattern pieces that are attached to the back panel 1012 along their respective flap edges using, for instance, stitching, bonding, welding, and the like. It is also contemplated herein that the back panel 1012, the first flap 112, the second flap 114, the third flap 116, and the fourth flap 118 may comprise a single pattern piece that is cut to shape. In this aspect, there would not be a seam line between the respective flap edges and the back panel 1012. Moreover, it is contemplated herein that instead of the pouch 110 comprising four flaps, the pouch 110, instead, may comprise a top flap (similar to the first flap 112) and a bottom flap (similar to the flap 118). In this aspect, the second looped cord segment 120 would extend through a hole in the top flap before receiving the first looped cord segment 130. Any and all aspects, and any variation thereof, are contemplated as being within aspects herein.

With emphasis now on FIGS. 8 and 9, the flaps 112, 114, 116, and 118 are configured to at least partially overlap each other when the pouch 110 is in a closed state. More specifically, at least the free ends 1014, 1020, 1026, and 1032 are configured to overlap each other so that the holes 1016, 1022, and 1028 are at least partially aligned or are in registration with each other. It is contemplated herein that the flap 118 be closed first. That is, the flap 118 is positioned to be closest to the back panel 1012, and/or the belt structure 100, and/or the stowed upper-body garment 132 when the flap 118 is closed. The remaining flaps 112, 114, and 116 may be positioned next in any order. For instance, the order may comprise fourth flap 118, second flap 114, third flap 116, and first flap 112. Or fourth flap 118, third flap 116, second flap 114, and first flap 112. Or fourth flap 118, first flap 112, second flap 114, and third flap 116. Or fourth flap 118, first flap 112, third flap 116, and second flap 114. Because the fourth flap 118 is positioned posterior to the remaining flaps 112, 114, and 116, the second looped cord segment 120 can be threaded through the holes 1016, 1022, and 1028 when the pouch 110 is in a closed state.

It is contemplated herein that openings may be formed in areas where the flaps 112, 114, 116, and 118 overlap with each other. For instance, with respect to FIGS. 8 and 9, the first opening 124 may be formed in the space between the first flap 112 and the second flap 114 and the second opening 128 may be formed in the space between the first flap 112 and the third flap 116. Additionally, a third opening 910 may be formed in the space between the second flap 114 and the fourth flap 118, and a fourth opening 912 may be formed in the space between the third flap 116 and the fourth flap 118.

As previously mentioned, when the upper-body garment 132 is stowed and the pouch is in a closed state, the first tab 122 may extend through the first opening 124 and the second tab 126 may extend through the second opening 128. Alternatively, the first tab 122 may extend through the third opening 910 and the second tab 126 may extend through the fourth opening 912. The fasteners 154 located on the first and second tabs 122 and 126 may be mated with the fasteners 914 located on the first flap 112 of the pouch 110; FIG. 8 shows the fasteners 154 and 914 mated, and FIG. 9 shows the fasteners 154 and 914 unmated. Securing the first and second tabs 122 and 126 when not in use helps to prevent the tabs 122 and 126 from distracting the wearer and improves the safety of the stowable garment system.

Now with particular respect to FIG. 8, when the pouch 110 is in a closed state and the tabs 122 and 126 of the upper-body garment 132 extend through the openings 124 and 128, the loop portion of the first looped cord segment 130 may be releasably threaded through the loop portion of the second looped cord segment 120. The loop portion of the first looped cord segment 130 may be further releasably secured to the pouch 110 using the hook 131, where the hook 131 is attached to the pouch structure by the tab 133. Securing the first looped cord segment 130 using the hook 131 may improve the safety of the stowable garment system and prevent the free end of the first looped cord segment 130 from distracting the wearer.

Continuing, before deploying the stowed upper-body garment 132, the first looped cord segment 130 may be first disengaged from the hook 131. Next, the first looped cord segment 130 may be further disengaged or pulled from the second looped cord segment 120 in response to a wearer exerting a tension force on the first tab 122. Once the first looped cord segment 130 is disengaged from the second looped cord segment 120, a continued anterior tension force on the first tab 122 and the second tab 126 causes the stowed upper-body garment 132 to expand anteriorly and the second looped cord segment 120 to be drawn posteriorly through the holes 1016, 1022, and 1028 as the flaps 112, 114, 116, and 118 expand outward effectively causing the pouch 110 to open.

Although the first looped cord segment 130 is shown as being positioned on the first tab 122, it is contemplated herein that the first looped cord segment 130 may be positioned on the second tab 126. This configuration, for instance, may be more suitable for left-handed wearers. Similarly, although the hook 131 is shown as being positioned adjacent to the third flap 116, it may be positioned adjacent to the second flap 114 when the first looped cord segment 130 is positioned on the second tab 126. Further, although a hook 131 is shown for temporarily securing the first looped cord segment 130, it is contemplated herein that other mechanisms may be used such as a quick-release clasp that receives the loop portion of the first looped cord segment 130. Any and all aspects, and any variation thereof, are contemplated as being within aspects herein.

Figure 11:
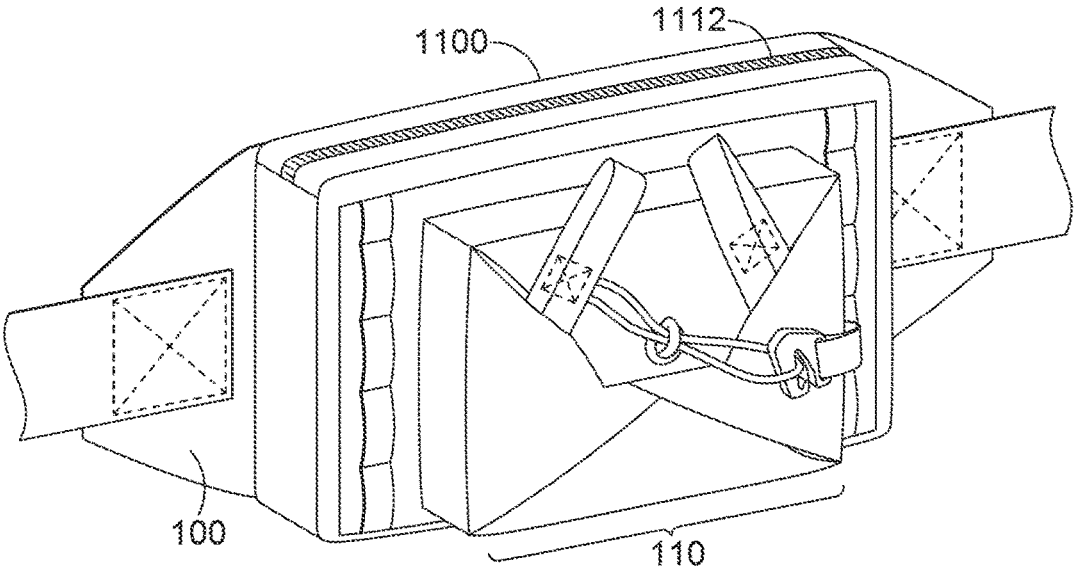
FIG. 11 illustrates an alternative construction for the belt structure comprising two pouches in accordance with aspects herein.

FIG. 11 illustrates an alternative configuration for the belt structure 100 where a second pouch 1100 is positioned between the pouch 110 and the belt structure 100. The second pouch 1100 may comprise a more traditional construction with one or more resealable openings 1112 for stowing items. In aspects, the back panel 1012 of the pouch 110 may be secured to a front panel of the second pouch 1100 along its perimeter edges. In turn, the belt structure 100 may be secured to the back panel of the second pouch 1100 at opposing sides of the back panel of the second pouch 1100.

Figure 12:
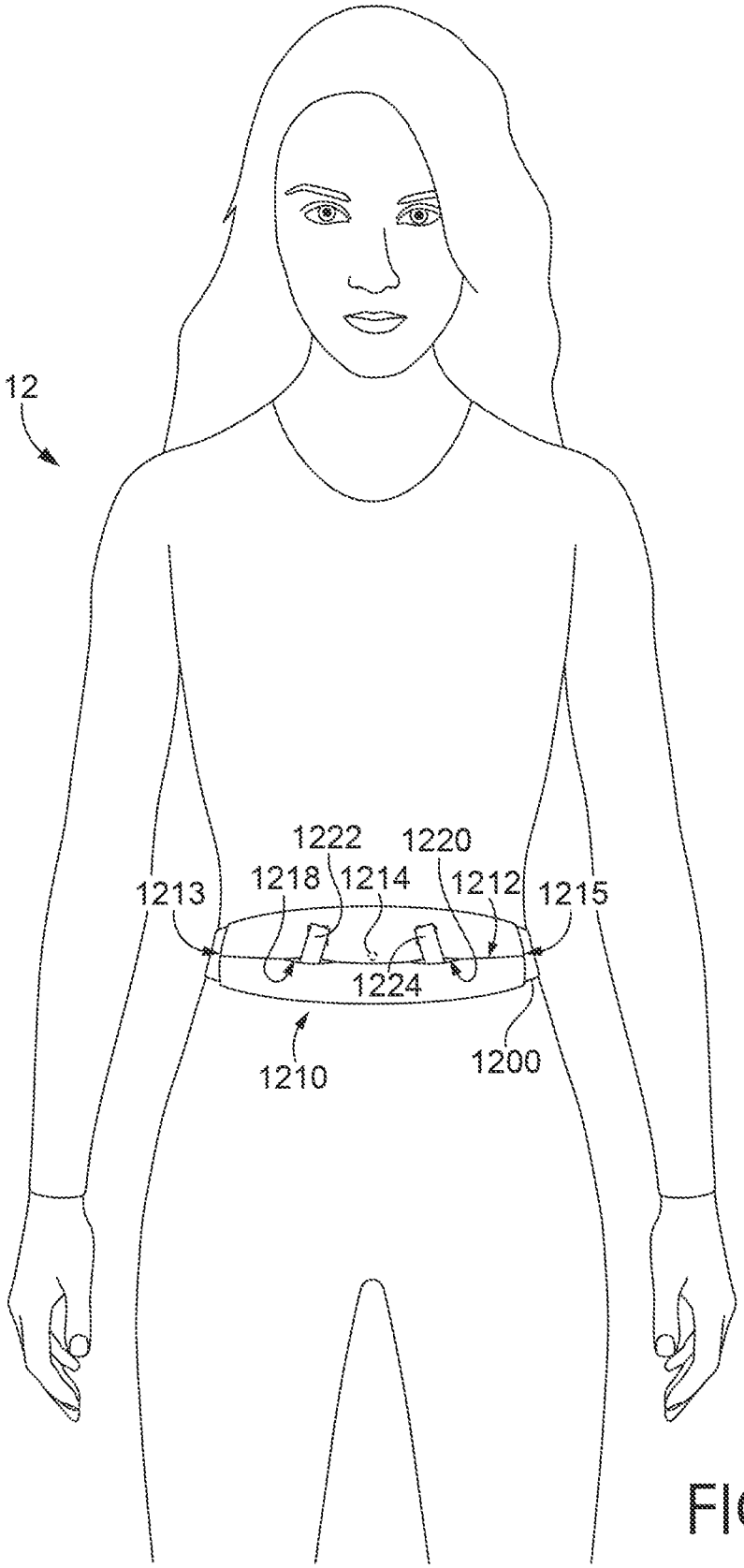
FIGS. 12-15 illustrate an example method of donning an upper-body garment stowed within an example pouch having an alternative construction in accordance with aspects herein.
Figure 13:
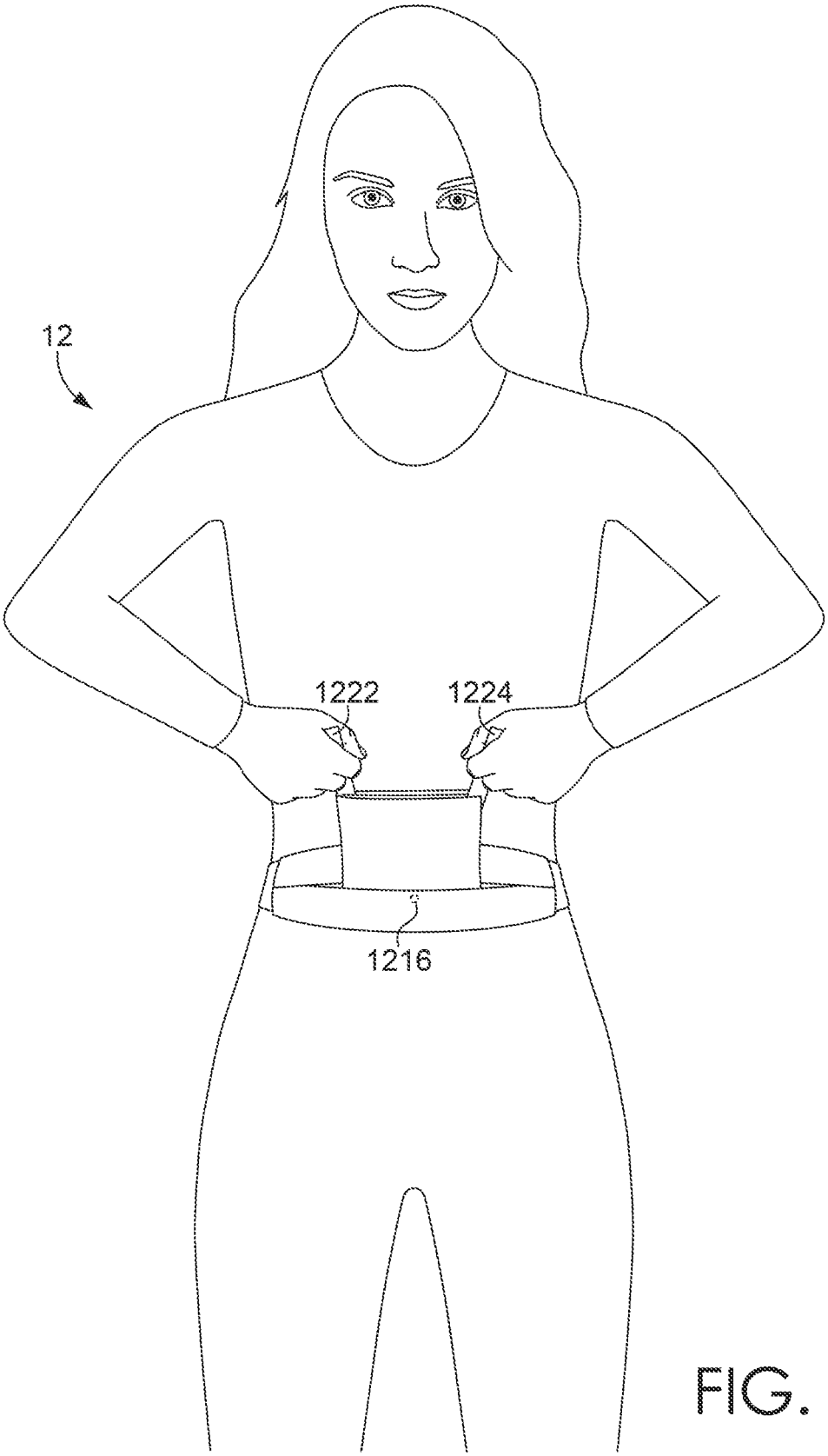
Figure 14:
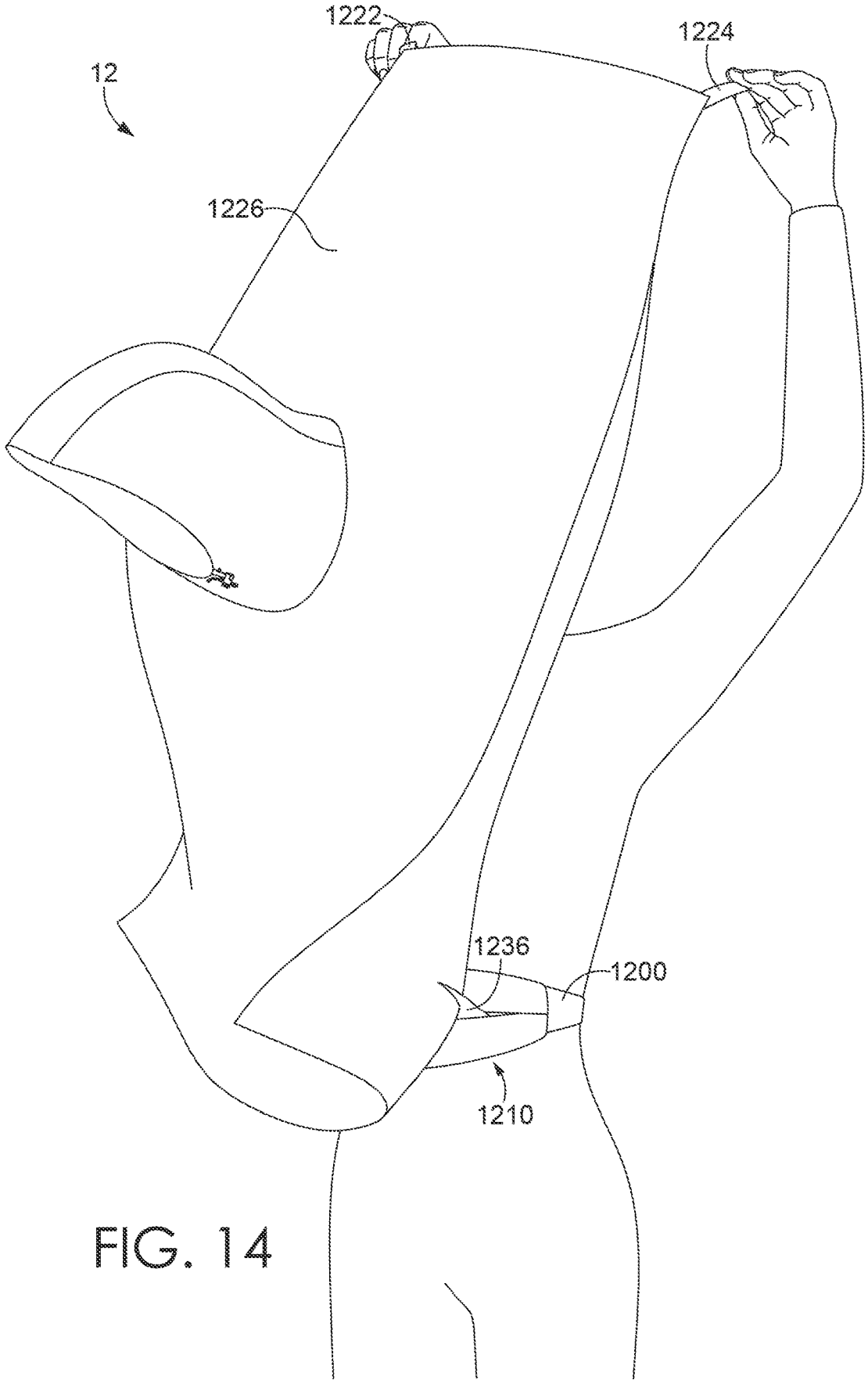

Turning now to FIGS. 12-14, an example method of quickly deploying and donning an upper-body garment that is part of a second alternative stowable garment system is provided in accordance with aspects herein. FIG. 12 depicts a wearer 12 wearing a belt structure 1200 around a waist area of the wearer 12. The belt structure 1200 comprises a pouch 1210 positioned generally on a front aspect of the belt structure 1200. The pouch 1210 comprises a horizontally oriented opening 1212 with a first fastening means 1214 positioned adjacent a first edge of the opening 1212 and a second fastening means (not visible) positioned adjacent to a second opposite edge of the opening 1212. As shown in FIG. 12, the first fastening means 1214 is coupled to the second fastening means at a general mid-point of the opening 1212. That is, the first fastening means 1214 and the second fastening means are located generally equidistant from a first end 1213 and a second end 1215 of the opening 1212. In aspects, the first fastening means 1214 and the second fastening means may comprise a magnetic snap assembly. Other example fastening means may comprise a traditional snap assembly, a hook-and-loop closure system, a releasable adhesive, and the like. The positioning of the first fastening means 1214 and the second fastening means creates a first opening 1218 between the first end 1213 and the first fastening means 1214 and the second fastening means when fastened and a second opening 1220 between the second end 1215 and the first fastening means 1214 and the second fastening means when fastened.

Continuing, as shown in FIG. 12, a first tab 1222 extends through the first opening 1218, and a second tab 1224 extends through the second opening 1220. In aspects, the first tab 1222 and the second tab 1224 may be releasably secured to the pouch 1210 when not in use. Similar to the stowable garment system of FIGS. 1-10, the first tab 1222 and the second tab 1224 may be part of an upper-body garment that is configured to be stowed within the pouch 1210.

Turning next to FIG. 13, the wearer 12 is shown with the wearer's right hand grasping the first tab 1222 and the wearer's left hand grasping the second tab 1224. The wearer 12 exerts at least an anterior or forward tension on the tabs 1222 and 1224 to cause the first fastener means 1214 to disengage from the second fastener means (indicated in FIG. 13 by reference numeral 1216). In aspects, the use of a magnetic snap system facilitates the quick disengagement of the fastening means 1214 and 1216 when tension is exerted on the first and second tabs 1222 and 1224.

FIG. 14 depicts the wearer 12 continuing to exert tension on the first tab 1222 and the second tab 1224 to deploy the upper-body garment (indicated by reference numeral 1226) from the pouch 1210 and to pull the upper-body garment 1226 over the wearer's head and upper torso. As seen, the first tab 1222 extends from a bottom margin of the upper-body garment 1226 at a first side of the back section of the upper-body garment 1226, and the second tab 1224 extends from the bottom margin of the upper-body garment 1226 at a second opposite side of the back section of the upper-body garment 1226. By positioning the tabs 1224 and 1224 in these areas, the wearer 12 can easily draw the upper-body garment 1226 over the wearer's head by moving his arms in an upward and backward direction. Similar to the stowable garment system of FIGS. 1-10, the movement to deploy the upper-body garment 1226 from the pouch 1210 and to pull the upper-body garment 1226 over the wearer's head may be accomplished in a single action as opposed to multiple separate actions as with some traditional stowable garment systems.

FIG. 14 further depicts an attachment area between the upper-body garment 1226 and the pouch 1210. More specifically, an attachment flap 1236 is positioned on an inner-facing surface of the front section of the upper-body garment 1226. The free edge of the attachment flap 1236 may be releasably or securedly affixed to an attachment area located on an inner aspect of the pouch 110 (better seen in FIG. 19 and indicated by reference numeral 1910 in FIG. 19).

Figure 15:
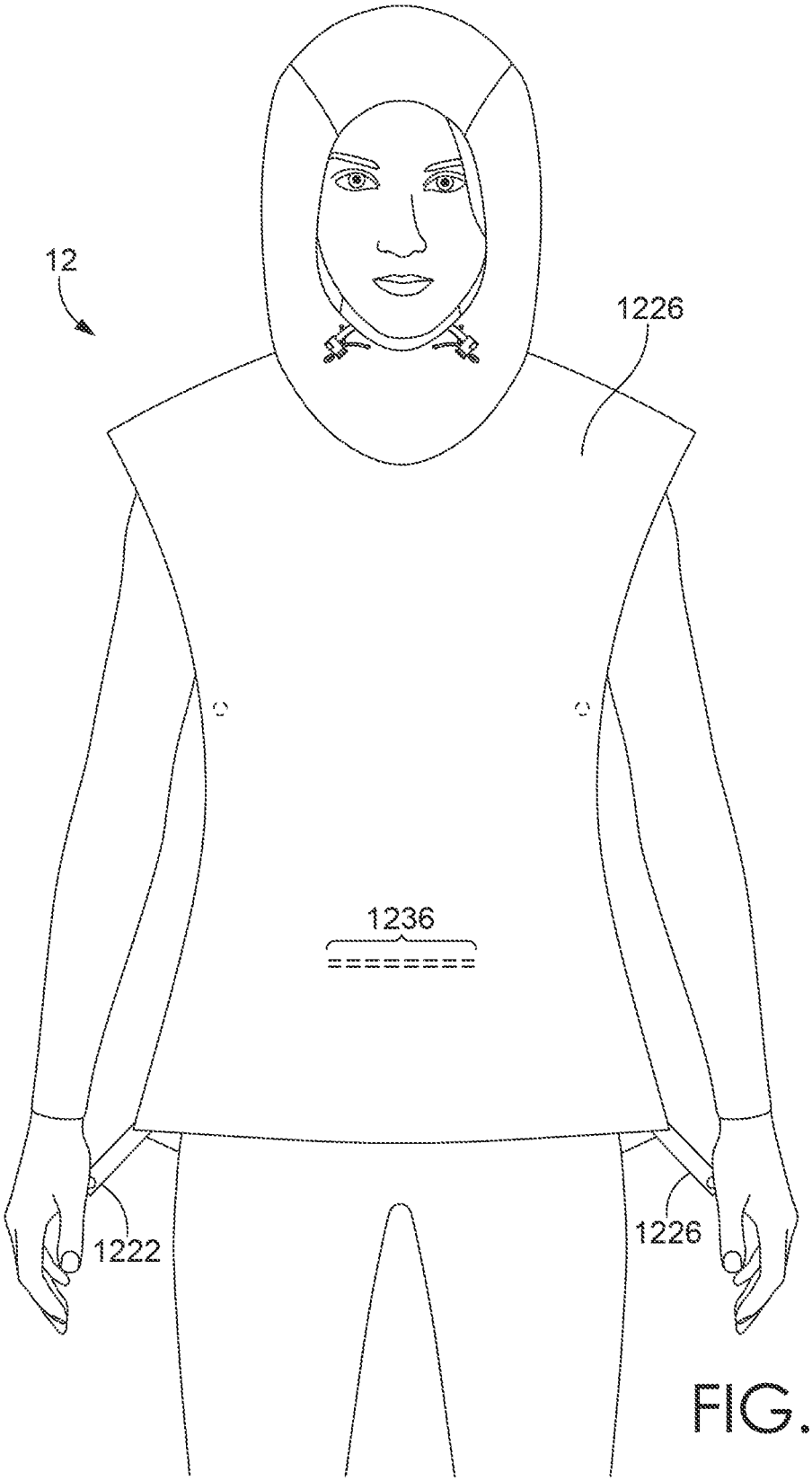

FIG. 15 depicts the wearer 12 with the upper-body garment 1226 in an as-worn configuration. Similar to the upper-body garment 132, the upper-body garment 1226, in aspects, may comprise a poncho construction with a hood.

The attachment flap 1236 is shown by dashed lines to indicate that it is located on an inner-facing surface of the front section and is generally hidden from view.

Figure 16:
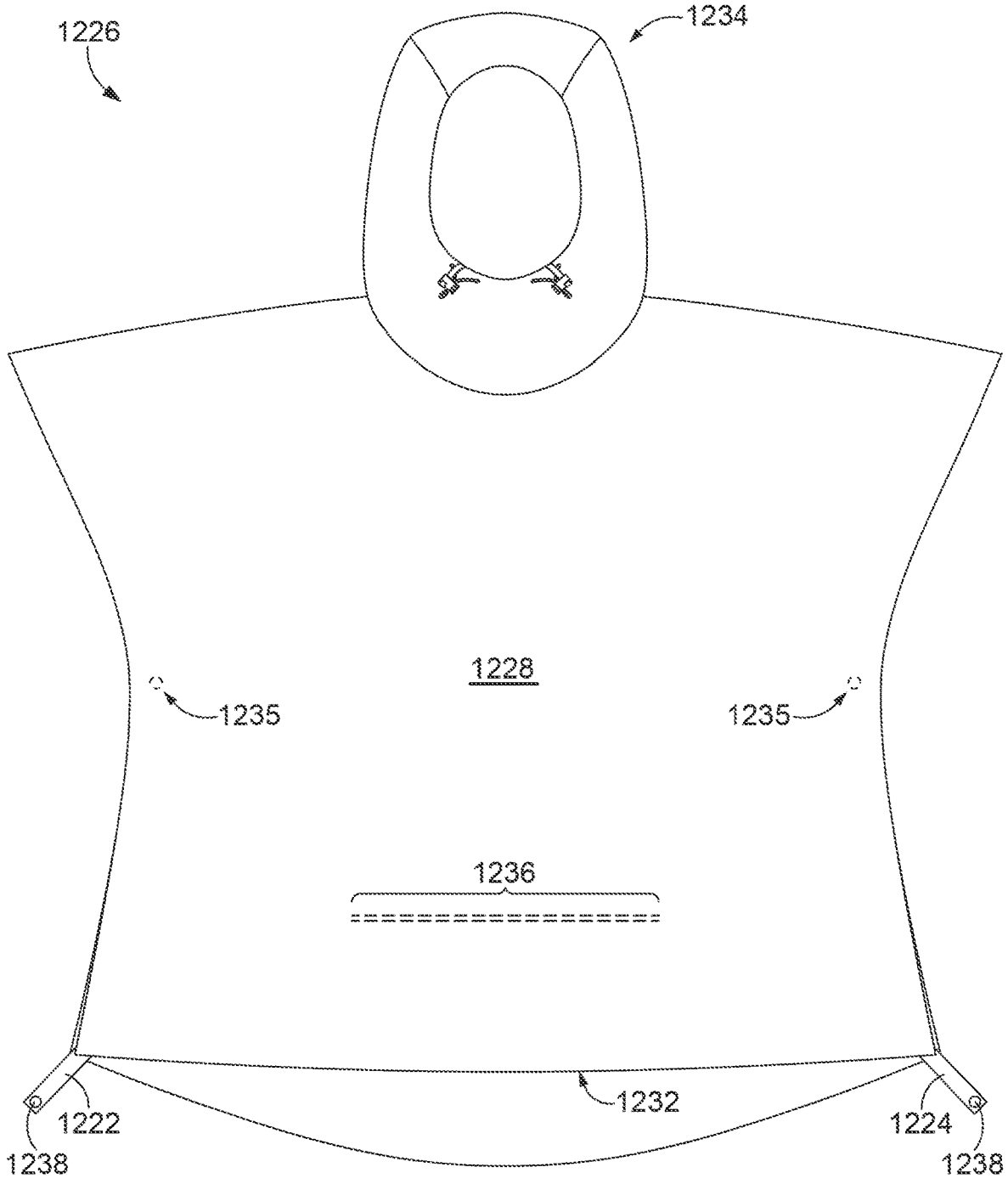
FIG. 16 illustrates a front view of the upper-body garment of FIGS. 12-15 in accordance with aspects herein.
Figure 17:
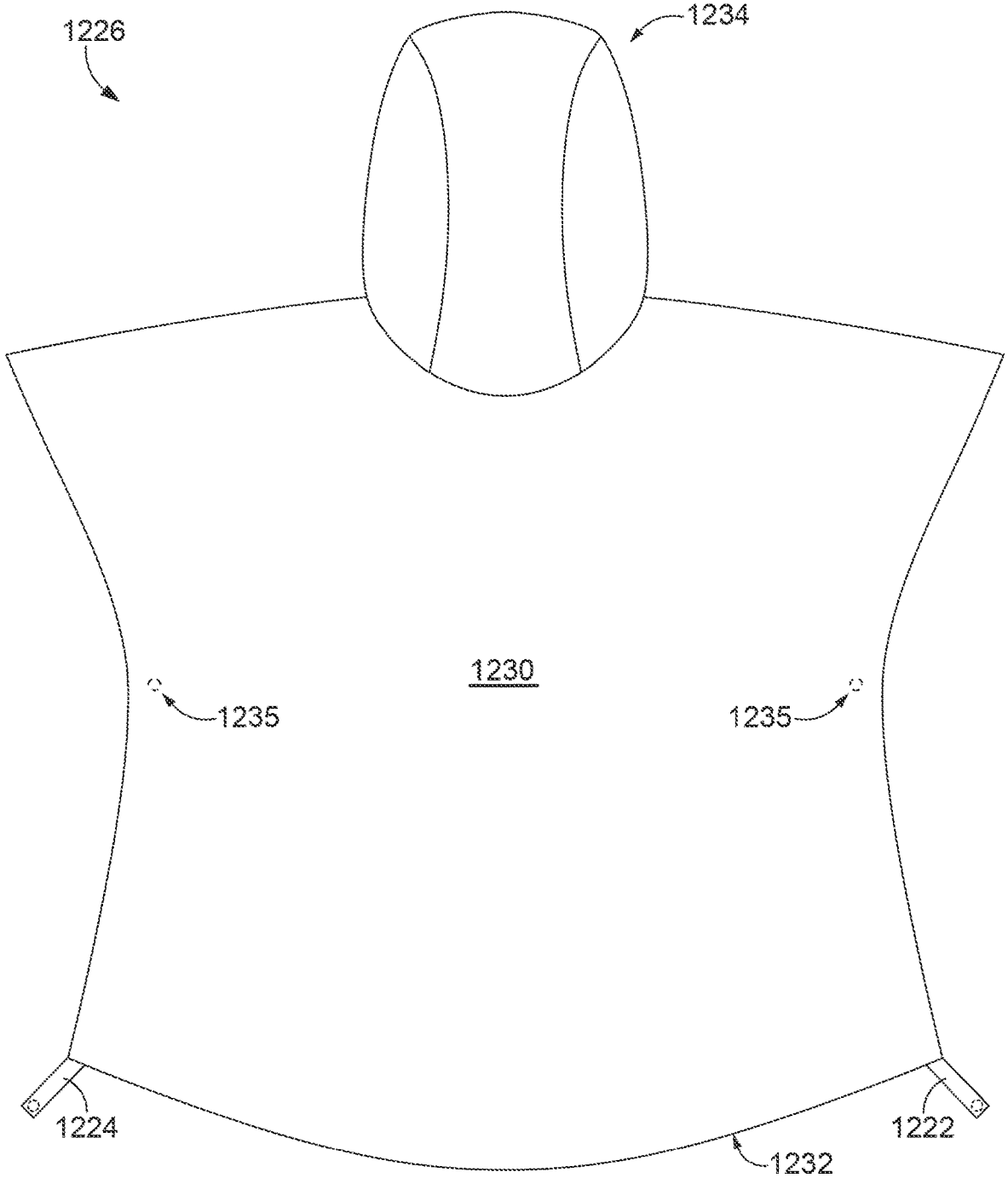
FIG. 17 illustrates a back view of the upper-body garment of FIG. 16 in accordance with aspects herein.

FIGS. 16 and 17 depict front and back views respectively of the upper-body garment 1226. In general, aspects of the upper-body garment 1226 are similar to the upper-body garment 132. For instance, the upper-body garment 1226 may be formed from a lightweight or ultra-lightweight tightly woven material formed, for example, using polyester and/or nylon yarns, where one or both surfaces may be treated with a DWR finish. Further, the upper-body garment 1226 comprises a front section 1228 (shown in FIG. 16) and a back section 1230 (shown in FIG. 17) extending from the front section 1228 at shoulder regions of the upper-body garment 1226. Each of the front section 1228 and the back section 1230 comprises a bottom margin 1232. The upper-body garment 1226 further comprises a hood 1234. The upper-body garment 1226 may comprise a reversible closure system (indicated by reference numeral 1235) located on the inner-facing surfaces of the front and back sections 1228 and 1230 adjacent to side margins of each, where the reversible closure system 1235 may be used to create arm holes after the upper-body garment 1226 has been donned.

The front section 1228 of the upper-body garment 1226 comprises the attachment flap 1236 located on the inner-facing surface of the front section 1228 (as indicated by the dashed lines), where the attachment flap 1236 is attached to the attachment area 1910 located on the inner aspect of the pouch 1210. Similar to the attachment flap 155, the attachment flap 1236 may be fixedly or releasably attached to the attachment area 1910. The placement, orientation, and dimensions of the attachment flap 1236 are similar to that described for the attachment flap 155 and, as such, will not be repeated here for brevity's sake.

With respect to the back view of the upper-body garment 1226 shown in FIG. 17, the first tab 1222 is shown extending from the bottom margin 1232 of the back section 1230 at a first side of the back section 1230, and the second tab 1224 is shown extending from the bottom margin 1232 of the back section 1230 at a second opposite side of the back section 1230. Unlike the first tab 122 of the upper-body garment 132, the first tab 1222 does not comprise a looped cord segment. To describe this in a different way, instead of the quick-release mechanism being located on both the upper-body garment and the pouch as described for the stowable garment system of FIGS. 1-10, the quick-release mechanism of the stowable garment system of FIGS. 12-19 is located just on the pouch 1210. The front view shown in FIG. 16 illustrates a fastener 1238 located on the forward-facing surface of each of the first tab 1222 and the second tab 1224, where the fastener 1238 is configured to releasably mate with a complementary second fastener located on the pouch 1210 as described below. In this aspect, the fastener 1238 is shown as a snap although it is contemplated herein that other types of fasteners may be used.

Figure 18:
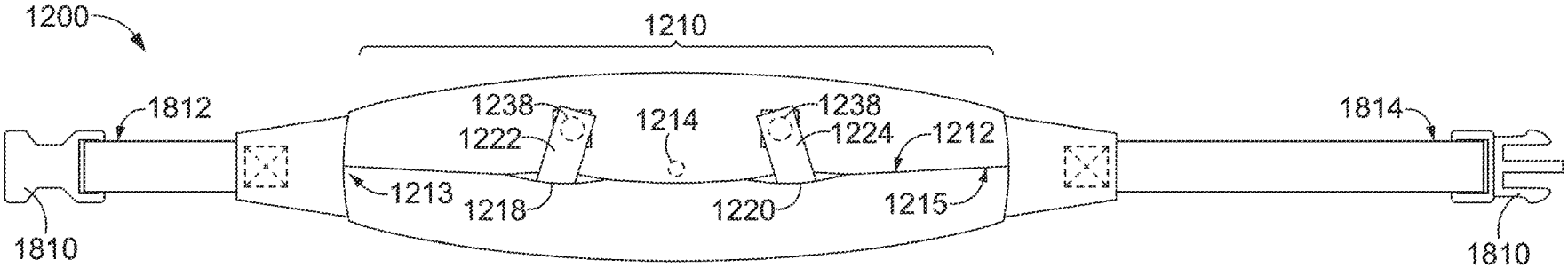
FIG. 18 illustrates the belt structure comprising the alternative configuration for the pouch of FIGS. 12-15 where the pouch is in a closed state in accordance with aspects herein.

FIG. 18 depicts a front view of the belt structure 1200 in accordance with aspects herein. The belt structure 1200 is configured to encircle the waist of a wearer and may comprise a buckle component 1810 at each of a first end 1812 and a second opposite end 1814 of the belt structure 1200, where the buckle components 1810 are configured to mate with each other and to optionally allow the wearer to adjust the girth of the belt structure 1200. In aspects, the first end 1812 and the second end 1814 are configured to be positioned at the back area of the wearer when the belt structure 1200 is worn. Similar to the buckle components 710, it is contemplated herein that the buckle components 1810 may comprise any number of buckle types known in the art.

The belt structure 1200 further comprises the pouch 1210 located at a front aspect of the belt structure 1200 when the belt structure 1200 is worn as intended and as described herein. The pouch 1210 is shown in a "closed" state and with the upper-body garment 1226 stowed within the pouch 1210. More particularly, the first fastening means 1214 is shown mated to the second fastening means 1216 to close the pouch 1210 and to create the first opening 1218 and the second opening 1220. The first tab 1222 is illustrated extending through the first opening 1218, and the second tab 1224 is shown extending through the second opening 1220. The first and second tabs 1222 and 1224 are further shown secured to the pouch 1210 by way of the fasteners 1238 located on the tabs 1222 and 1224.

Figure 19:
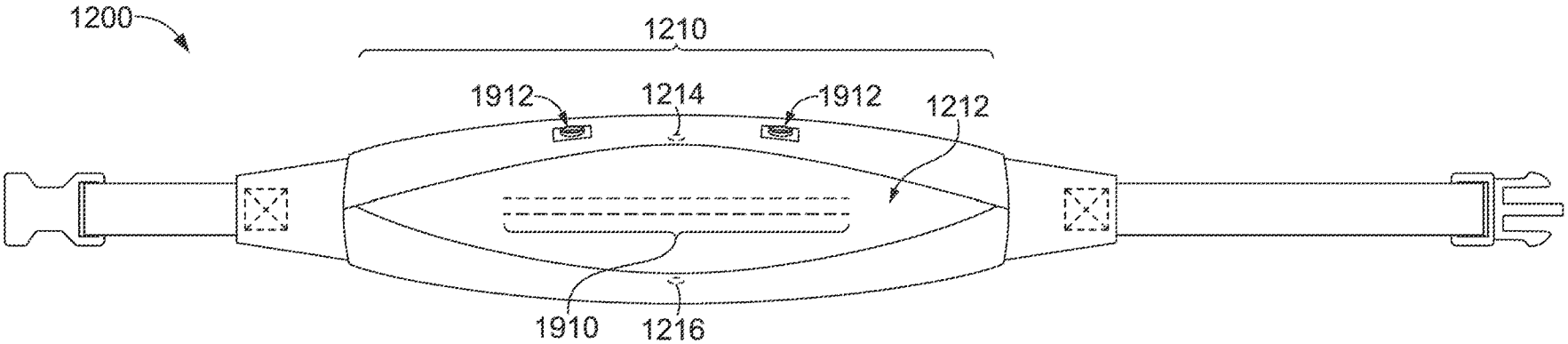
FIG. 19 illustrates the belt structure of FIG. 18 with the pouch in an open state and with the upper-body garment removed in accordance with aspects herein.

FIG. 19 illustrates the belt structure 1200 and the pouch 1210 in an open state and without the stowed upper-body garment 1226 in accordance with aspects herein. As shown in FIG. 19, the interior of the pouch 1210 includes the attachment area 1910 which is where the attachment flap 1236 of the front section 1228 of the upper-body garment 1226 attaches to the pouch 1210. FIG. 19 further illustrates fasteners 1912 that are complementary to the fasteners 1238 located on the first tab 1222 and the second tab 1224. The fasteners 1912 are positioned on an outer-facing surface of the pouch 1210 adjacent to the first edge of the opening 1212 (within about 1 cm to about 6 cm of the first edge forming the opening 1212) and located on either side of the fastening means 1214. It is also contemplated herein that the fasteners 1912 may be positioned on the outer-facing surface of the pouch 1210 adjacent to the second edge of the opening 1212 and located on either side of the fastening means 1216. Any and all aspects, and any variation thereof, are contemplated as being within aspects herein.

Figure 20:
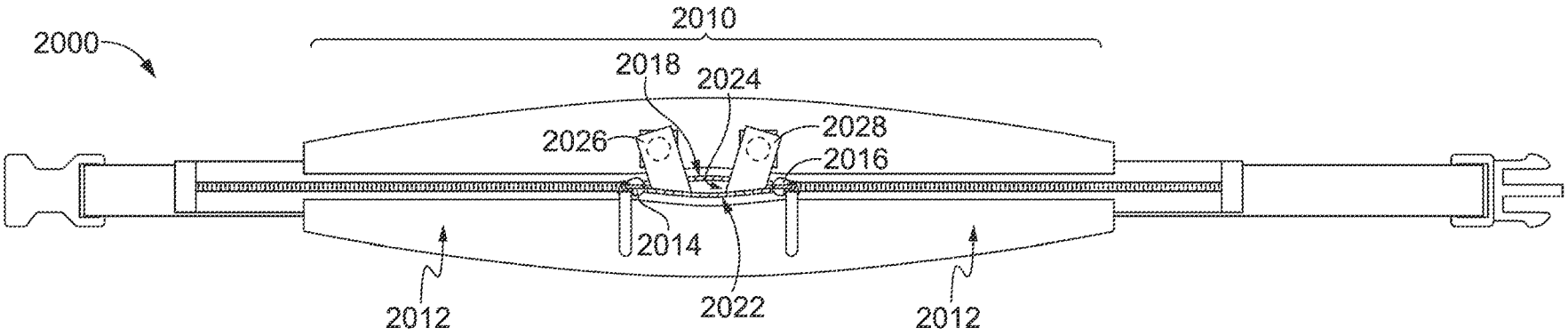
FIG. 20 illustrates an example belt structure having a second alternative configuration for a pouch useable for stowing an upper-body garment in accordance with aspects herein.

FIG. 20 illustrates a belt structure 2000 with an alternative pouch 2010 in accordance with aspects herein. The belt structure 2000 and the pouch 2010 are similar to the belt structure 1200 and the pouch 1210 except for the quick-release mechanism. Instead of using a snap system, the pouch 2010 includes a slider assembly 2012 to quickly open and close the pouch 2010. More specifically, the slider assembly 2012 may comprise a first slider body 2014 and a second slider body 2016 each having a slider mouth that oppose each other. The slider assembly 2012 further comprises a first set of slider elements 2018 positioned along a first edge of a horizontally oriented opening and a second set of slider elements 2022 positioned along a second opposite edge of the opening where the first and second slider bodies 2014 and 2016 are engaged with the slider elements 2018 and 2022 at one or more areas. In aspects, the first and second slider bodies 2014 and 2016 may not comprise a stopper such that the slider bodies 2014 and 2016 freely move along the slider elements 2018 and 2022 when subjected to a minimal force.

Continuing, to "close" the pouch 2010, the slider bodies 2014 and 2016 are moved toward each other but a space is maintained between the slider bodies 2014 and 2016 to create an opening 2024 through which a first tab 2026 and a second tab 2028 of an upper-body garment extend. In aspects, the opening 2024 may be from about 10 cm to about 20 cm in length. To "open" the pouch 2010, a wearer may exert at least an anterior or outward tension force on the first tab 2026 and the second tab 2028. Because the tabs 2026 and 2028 are connected to the upper-body garment, exerting an anterior or outward tension of the tabs 2026 and 2028 causes the upper-body garment to exert a force on the slider bodies 2014 and 2016 causing the slider bodies 2014 and 2016 to move away from each other (due to a lack of a stopping mechanism) thereby expanding the opening 2024 and enabling the upper-body garment to be withdrawn from the pouch 2010 and donned.

It is contemplated herein that the stowable garment system shown in FIG. 20 may comprise some of the same features as the stowable garment system shown in FIGS. 14-19 such as features associated with the upper-body garment, fasteners located on the tabs of the upper-body garment and the complementary fasteners located on the pouch to secure the tabs when not in use, and the like.

Figure 21:
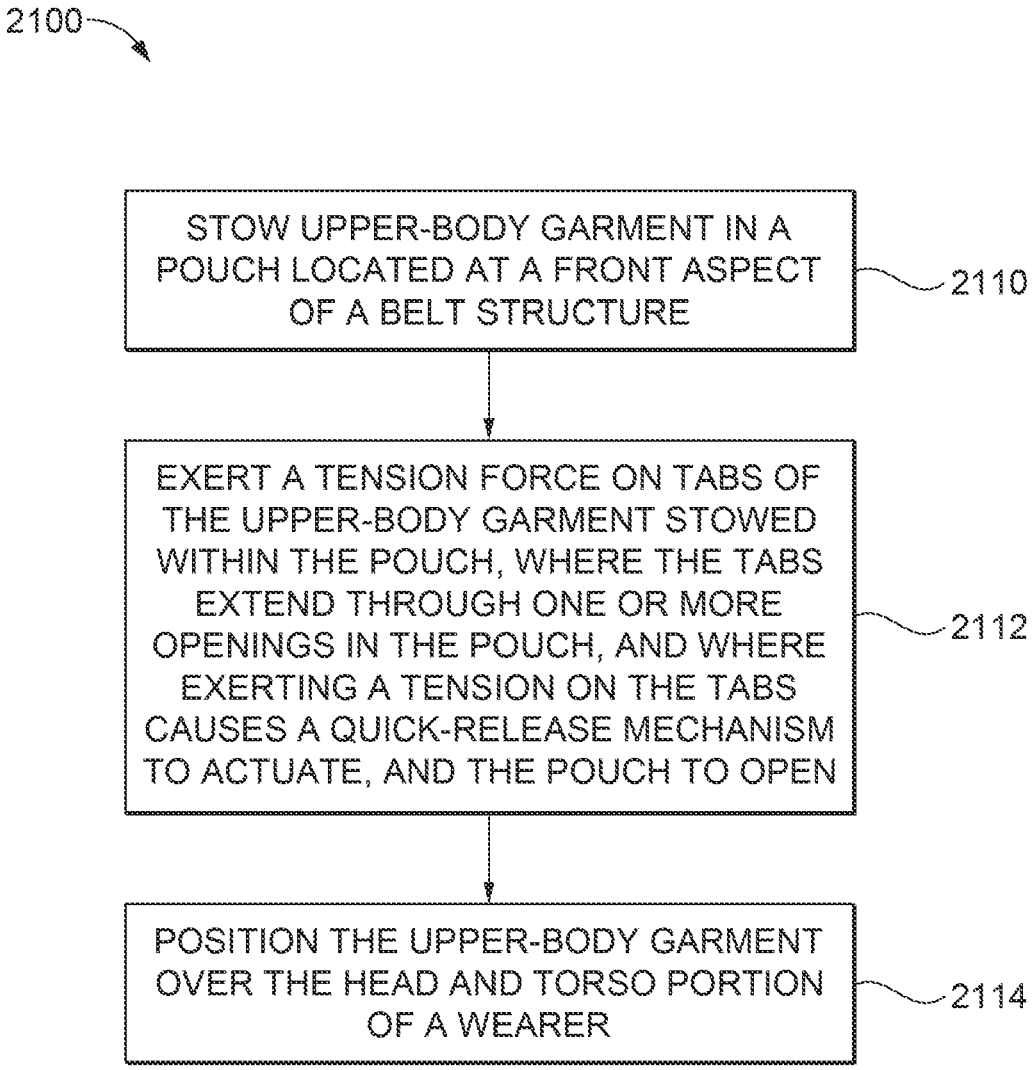
FIG. 21 illustrates a flow diagram of an example method for transitioning an upper-body garment from a stowed state to a worn state in accordance with aspects herein.

Turning now to FIG. 21, FIG. 21 depicts a flow diagram of an example method 2100 for transitioning an upper-body garment from a stowed state to a worn state. The upper-body garment may comprise the upper-body garment of the stowable garment system of FIGS. 1-11, FIGS. 12-19, or FIG. 20. In aspects, the upper-body garment comprises a front section, a back section, a bottom margin, a first tab extending from the bottom margin at a first side of the back section and a second tab extending from the bottom margin at a second side of the back section.

The method comprises, at a step 2110, stowing the upper-body garment in a pouch located on a front aspect of a belt structure configured to be worn around a waist of a wearer. In aspects, at least the pouch comprises a quick-release mechanism effective to open and close the pouch. Moreover, a portion of the front section of the upper-body garment is attached to the pouch, the first tab extends through a first opening in the pouch and the second tab extends through a second opening in the pouch. At a step 2112, a tension force is exerted on the first tab and the second tab of the upper-body garment to cause the quick-release mechanism to actuate, the pouch to open, and the upper-body garment to be deployed from the pouch. Next, at a step 2114, the upper-body garment is positioned over a head and torso portion of the wearer by continuing to exert the tension force on the first tab and the second tab.

Aspects of the present disclosure have been described with the intent to be illustrative rather than restrictive. Alternative aspects will become apparent to those skilled in the art that do not depart from its scope. A skilled artisan may develop alternative means of implementing the aforementioned improvements without departing from the scope of the present invention.

It will be understood that certain features and subcombinations are of utility and may be employed without reference to other features and subcombinations and are contemplated within the scope of the claims. Not all steps listed in the various figures need be carried out in the specific order described.

What is claimed is:

1. A stowable garment system comprising:

a belt structure having a pouch, the pouch comprising:

a horizontally oriented opening having a first edge, a second edge, a first end, and a second end;

a slider assembly comprising a first set of slider elements positioned along the first edge of the horizontally oriented opening, a second set of slider elements positioned along the second edge of the horizontally oriented opening, a first slider body, and a second slider body, the first slider body and the second slider body engaged with the first set of slider elements and the second set of slider elements; and a pair of releasable fasteners positioned adjacent to the first edge of the horizontally oriented opening; and an upper-body garment including a front section, a back section, and a bottom margin, wherein a portion of the front section is attached to the pouch, and wherein the back section includes a first tab extending from the bottom margin and a second tab extending from the bottom margin, each of the first tab and the second tab including a fastener, wherein when the upper-body garment is stowed within the pouch, the fastener on the first tab of the upper-body garment is mated to a first releasable fastener of the pair of releasable fasteners positioned on the pouch and the fastener on the second tab of the upper-body garment is mated to a second releasable fastener of the pair of releasable fasteners positioned on the pouch.

2. The stowable garment system of claim 1, wherein when the upper-body garment is stowed within the pouch, the first tab and the second tab each extend through the horizontally oriented opening.

3. The stowable garment system of claim 1, wherein the upper-body garment comprises a poncho.

4. The stowable garment system of claim 1, wherein the portion of the front section is attached to an inner aspect of the pouch.

5. The stowable garment system of claim 1, wherein the upper-body garment is formed from a woven fabric having a weight less than or equal to 150 grams per square meter (GSM).

6. The stowable garment system of claim 5, wherein the weight of the woven fabric is less than or equal to 100 GSM.

7. The stowable garment system of claim 1, wherein the pair of releasable fasteners are positioned adjacent to the first edge of the horizontally oriented opening.

8. The stowable garment system of claim 7, wherein the pair of releasable fasteners are positioned within 1 cm to 6 cm of the first edge of the horizontally oriented opening.

9. The stowable garment system of claim 7, wherein the first releasable fastener is positioned on a first side of a vertical midline of the pouch, and wherein the second releasable fastener is positioned on a second opposite side of the vertical midline of the pouch.

10. The stowable garment system of claim 1, wherein the pair of releasable fasteners are positioned adjacent to the second edge of the horizontally oriented opening.

11. The stowable garment system of claim 10, wherein the first releasable fastener is positioned on a first side of a vertical midline of the pouch, and wherein the second releasable fastener is positioned on a second opposite side of the vertical midline of the pouch.

12. The stowable garment system of claim 1, wherein a stopper is absent from each of the first slider body and the second slider body.

13. The stowable garment system of claim 1, wherein the horizontally oriented opening is between 10 cm and 20 cm in length.

14. A stowable garment system comprising:

a belt structure having a pouch, the pouch comprising:

a horizontally oriented opening having a first edge, a second edge, a first end, and a second end;

a slider assembly comprising a first set of slider elements positioned along the first edge of the horizontally oriented opening, a second set of slider elements positioned along the second edge of the horizontally oriented opening, a first slider body, and a second slider body, the first slider body and the second slider body engaged with the first set of slider elements and the second set of slider elements; and a pair of releasable fasteners positioned adjacent to the first edge of the horizontally oriented opening; and an upper-body garment stowed within the pouch, the upper-body garment including a front section, a back section, and a bottom margin, wherein a portion of the front section is attached to the pouch, and wherein the back section includes a first tab extending from the bottom margin and a second tab extending from the bottom margin, each of the first tab and the second tab including a fastener that is complementary to the pair of releasable fasteners positioned on the pouch.

15. The stowable garment system of claim 14, wherein the upper-body garment comprises a poncho.

16. The stowable garment system of claim 14, wherein the first tab and the second tab each extend through the horizontally oriented opening.

17. The stowable garment system of claim 14, wherein the pair of releasable fasteners are positioned adjacent to the first edge of the horizontally oriented opening.

18. The stowable garment system of claim 14, wherein the pair of releasable fasteners are positioned within 1 cm to 6 cm of the first edge of the horizontally oriented opening.

19. The stowable garment system of claim 14, wherein a stopper is absent from each of the first slider body and the second slider body.

20. The stowable garment system of claim 14, wherein the horizontally oriented opening is between 10 cm and 20 cm in length.

* * * * *